US009373462B2

(12) United States Patent
Saomoto

(10) Patent No.: US 9,373,462 B2
(45) Date of Patent: Jun. 21, 2016

(54) PUSH SWITCH

(71) Applicant: HOSIDEN CORPORATION, Yao-shi (JP)

(72) Inventor: Takuhiko Saomoto, Yao (JP)

(73) Assignee: HOSIDEN CORPORATION, Yao-shi (JP)

( * ) Notice: Subject to any disclaimer, the term of this patent is extended or adjusted under 35 U.S.C. 154(b) by 113 days.

(21) Appl. No.: 14/140,864

(22) Filed: Dec. 26, 2013

(65) Prior Publication Data

US 2014/0183015 A1 Jul. 3, 2014

(30) Foreign Application Priority Data

Dec. 28, 2012 (JP) ..... 2012-287223

(51) Int. Cl.

| | |
|---|---|
| ***H01H 13/52*** | (2006.01) |
| ***H01H 13/10*** | (2006.01) |
| ***H01H 13/02*** | (2006.01) |
| *H01H 3/50* | (2006.01) |
| *H01H 9/16* | (2006.01) |

(52) U.S. Cl.

CPC ..... *H01H 13/10* (2013.01); *H01H 13/023* (2013.01); *H01H 13/52* (2013.01); *H01H 3/50* (2013.01); *H01H 9/161* (2013.01); *H01H 2219/066* (2013.01)

(58) Field of Classification Search

CPC ..... H01H 13/10; H01H 3/50; H01H 13/52; H01H 9/161; H01H 13/023; H01H 2219/066

USPC ..... 200/341, 293, 314

See application file for complete search history.

(56) References Cited

U.S. PATENT DOCUMENTS

| | | | |
|---|---|---|---|
| 6,087,601 | A | 7/2000 | Callender et al. |
| 6,667,451 | B1 | 12/2003 | Hart |
| 2010/0206705 | A1 | 8/2010 | Yamamoto |
| 2011/0290623 | A1 | 12/2011 | Hart et al. |

FOREIGN PATENT DOCUMENTS

| | | |
|---|---|---|
| EP | 1758138 A2 | 2/2007 |
| JP | 6-70132 U | 9/1994 |
| JP | H6-62438 | 9/1994 |

OTHER PUBLICATIONS

Extended European Search Report dated Apr. 8, 2014 issued in counterpart application No. 13250129.7.

*Primary Examiner* — Felix O Figueroa

(74) *Attorney, Agent, or Firm* — Kratz, Quintos & Hanson, LLP

(57) ABSTRACT

The invention provides a push switch including a keytop movable in a first direction, a switch, first and second circuit boards, an electronic component mounted on the second circuit board, first and second circuits electrically connected to the switch, and a body. The switch is turned on or off in response to movement of the keytop. The first circuit on the first circuit board is configured to protect the switch. The second circuit on the second circuit board is configured to actuate the electronic component in response to a turn-on or turn-off of the switch. The body includes a main body and first and second holders. The first holder at the main body holds the first circuit board. The second holder at the main body or the first holder holds the second circuit board in spaced relation to the first circuit board in the first direction.

15 Claims, 10 Drawing Sheets

PUSH SWITCH

CROSS-REFERENCE TO RELATED APPLICATIONS

The present application claims priority under 35 U.S.C. §119 of Japanese Patent Application No. 2012-287223 filed on Dec. 28, 2012, the disclosure of which is expressly incorporated by reference herein in its entity.

BACKGROUND OF THE INVENTION

1. Technical Field

The present invention relates to push switches.

2. Background Art

Japanese Unexamined Utility Model Application Publication No. 06-62438 discloses a push switch including a circuit board, a keytop, a depression switch, and an LED. The keytop is disposed so as to be movable toward the circuit board. The depression switch is mounted on the circuit board and is turned on in response to the movement of the keytop. The LED is mounted on the circuit board and turned on by the turn-on of the depression switch.

SUMMARY OF INVENTION

In the above push switch, the depression switch and the LED are mounted on the circuit board, so that a protection circuit for protecting the depression switch and an illumination circuit for turning on the LED are also provided on the circuit board. This arrange requires a large circuit board, and it is therefore difficult to reduce the external size of the push switch.

Further, the depression switch, the protection circuit, the LED, and the illumination circuit are arranged on the same circuit board. Therefore, the above push switch cannot be modified to a structure that requires neither LEDs nor illumination circuits.

The invention has been devised in view of the above situation and provides a push switch that can be downsized and has high versatility.

An aspect of the invention provides a push switch including a keytop, a switch, first and second circuit boards, an electronic component, first and second circuits, and a body. The keytop is movable in a first direction. The switch is configured to be turned on or off in response to movement of the keytop. The first and second circuit boards are electrically connected to the switch. The electronic component is mounted on the second circuit board. The first circuit is provided on the first circuit board and configured to protect the switch. The second circuit is provided on the second circuit board and configured to actuate the electronic component in response to a turn-on or turn-off of the switch. The body includes a main body and first and second holders. The first holder is provided at the main body and configured to hold the first circuit board. The second holder is provided at the main body or the first holder and is configured to hold the second circuit board in spaced relation to the first circuit board in the first direction.

The push switch of such an aspect has a reduced projected area from the first direction, resulting in downsizing of the push switch. This is because the first circuit for protecting the switch is provided in the first circuit board, the electronic component and the second circuit for actuating the electronic component are provided in the second circuit board, and the first and second circuit boards are held in spaced relation to each other along the first direction by the first and second holders of the body. Further advantageously, the above push switch has a high versatility. Particularly, by removing the second circuit board provided with the electronic component and the second circuit, the push switch can be modified to a push switch that does not require any electronic components. Alternatively, by replacing the second circuit board with another second circuit board that is provided with a different electronic component and a different second circuit for actuating the electronic component, the push switch can also be applied to a push switch for actuating a different electronic component.

The switch may include first and second fixed contacts and a movable contact. The first and second fixed contacts may each be a metal plate passing through the first and second circuit boards. The movable contact at an initial position may not be in contact with at least one of the first fixed and second fixed contacts, and the movable contact may be movable from the initial position in response to the movement of the keytop to be in contact with the first and second fixed contacts. Alternatively, the movable contact at an initial position may be in contact with the first fixed and second fixed contacts, and the movable contact may be movable from the initial position in response to the movement of the keytop so as to be brought out of contact with at least one of the first and second fixed contacts.

According to the push switch of these aspects, by making the first and second fixed contacts pass through the first and second circuit board, the first and second circuit boards are held by and also electrically connected to the first and second fixed contacts. This arrangement facilitates the fixing of the first and second circuit boards and the electrical connection between the first and second fixed contacts and the first and second circuit boards.

The body may partially hold the first and second fixed contacts. The first and second fixed contacts may each include a connection portion. The connecting portion may be disposed outside the body and pass through the first and second circuit boards.

According to the push switch of such an aspect, the connection portions of the first and second fixed contacts are arranged outside the body, and penetrate the first and second circuit boards. Therefore, the first and second circuit boards can be held by the first and second holders of the body, and the connection portions of the first and second fixed contacts can penetrate the first and second circuit boards to achieve electrical connection therebetween.

The second holder may include a plurality of pillars on the first holder. The pillars may extend in the first direction. The second circuit board may be held on the pillars. The first circuit board may be placed on the first holder so as to abut the pillars and be fixed in position by the pillars.

In the push switch of this aspect, when the first circuit board is placed on the first holder and brought into abutment with the pillars, the first circuit board is fixed in position by the pillars. Therefore, it is easy to fix the first circuit board in position.

The first circuit board may include a guide recess configured to fittingly receive the pillars in a movable manner in the first direction.

The push switch of this aspect makes it possible to move the first circuit board in the first direction by fitting the pillars in the guide recess of the first circuit board. The pillars guide the first circuit board so as to be placed on the first holder. Therefore, this aspect of the invention makes it easy to place and fix the first circuit board in position on the first holder.

DESCRIPTION OF EMBODIMENTS

Figure 1A:
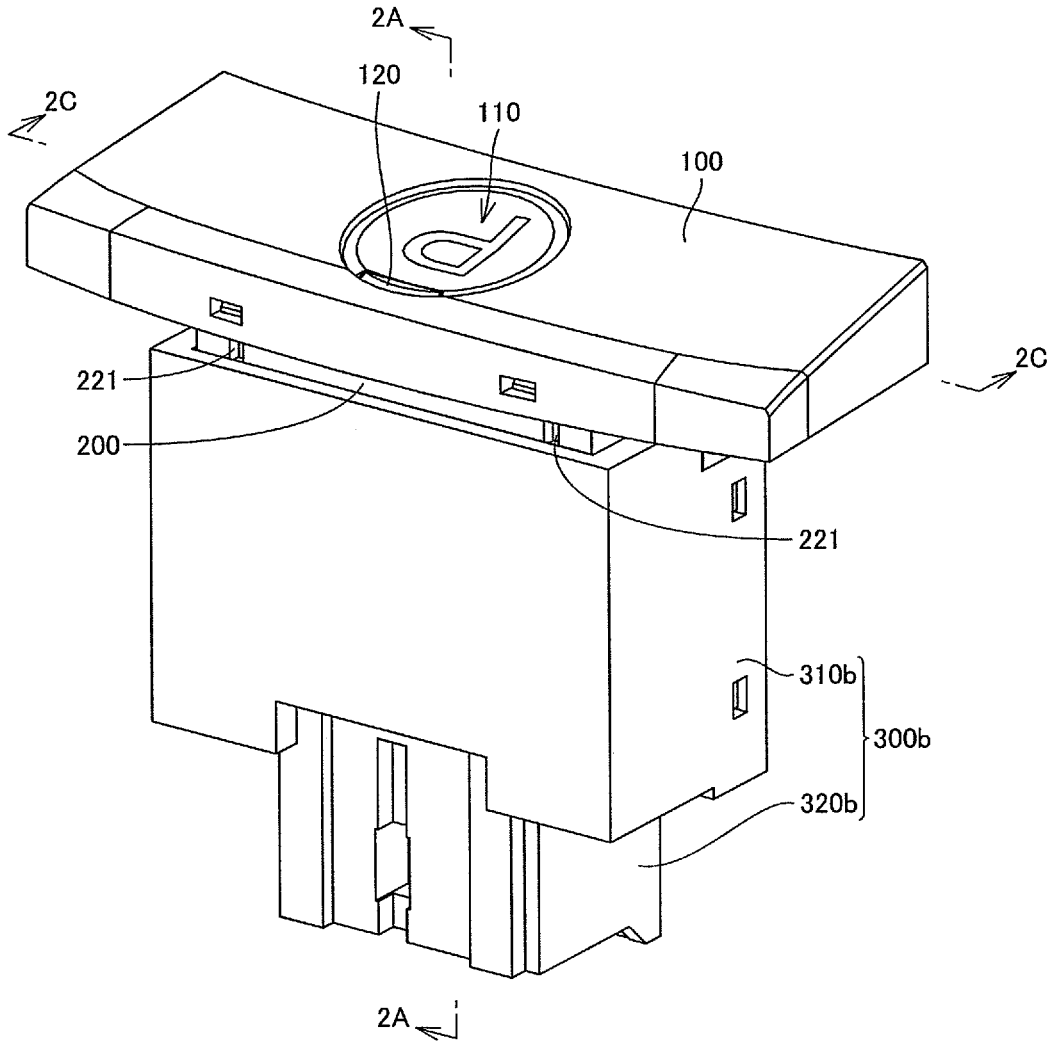
FIG. 1A is a front, top, right side perspective view of a push switch according to an embodiment of the invention.
Figure 1B:
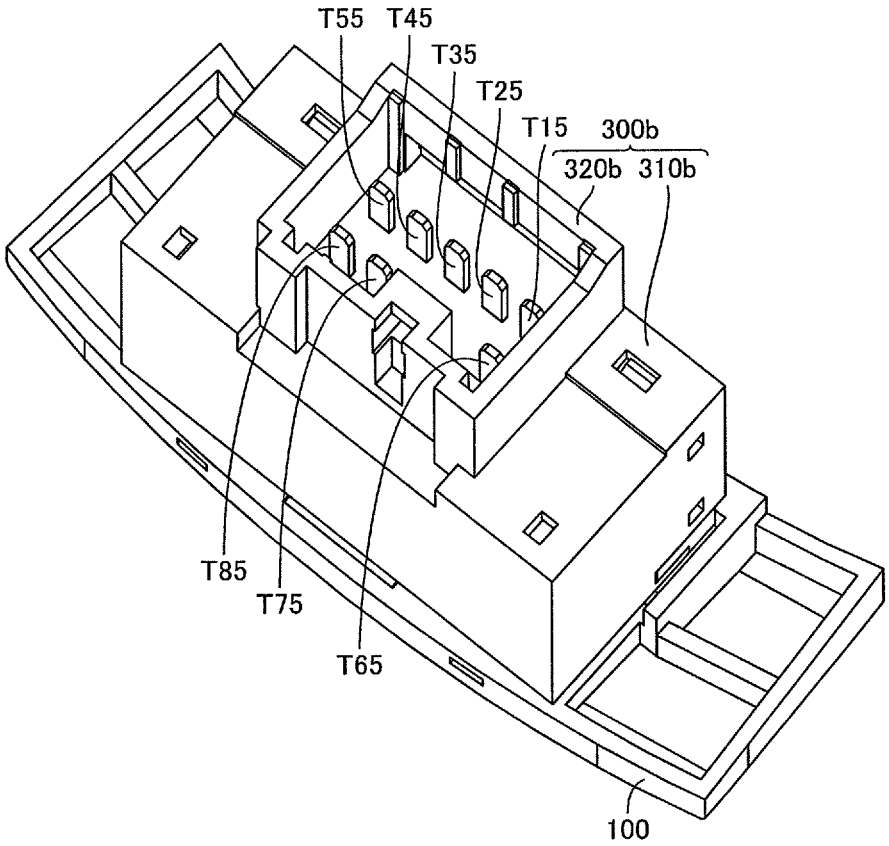
FIG. 1B is a front, bottom, and left side perspective view of the push switch.

A push switch according to an embodiment of the invention will be described below with reference to FIGS. 1A to 5B. The push switch illustrated in FIGS. 1A and 1B is a parking switch in which a P mark 110 grows by depressing a keytop 100 in a first direction Z. The push switch includes the keytop 100, a slider 200, a body 300*a*, a case 300*b*, switches S1 and S2, terminals T1, T2, T3, T4, T5, T6, T7 and T8, first and second circuit boards 400*a* and 400*b*, electronic components 500*a* and 500*b*, a pair of first circuits 600*a*, a pair of second circuits 600*b*, a lens 700*a*, a light shield block 700*b*, a coil spring 800, and a tactile feel generator 900. These components of the push switch will be described below in detail. The first direction Z indicated in FIGS. 2A to 3B is the height direction of the push switch as well as a movement direction of the keytop 100. A second direction X indicated in FIGS. 2C to 3B is the width direction of the push switch. A third direction Y indicated in FIGS. 2A, 2B, 3A and 3B is the depth direction of the push switch. The second direction X is perpendicular to the first direction Z. The third direction Y is perpendicular to the first direction Z and the second direction X. For convenience of explanation, the slider 200 is illustrated in broken lines in FIGS. 2C and 2D.

Figure 3A:
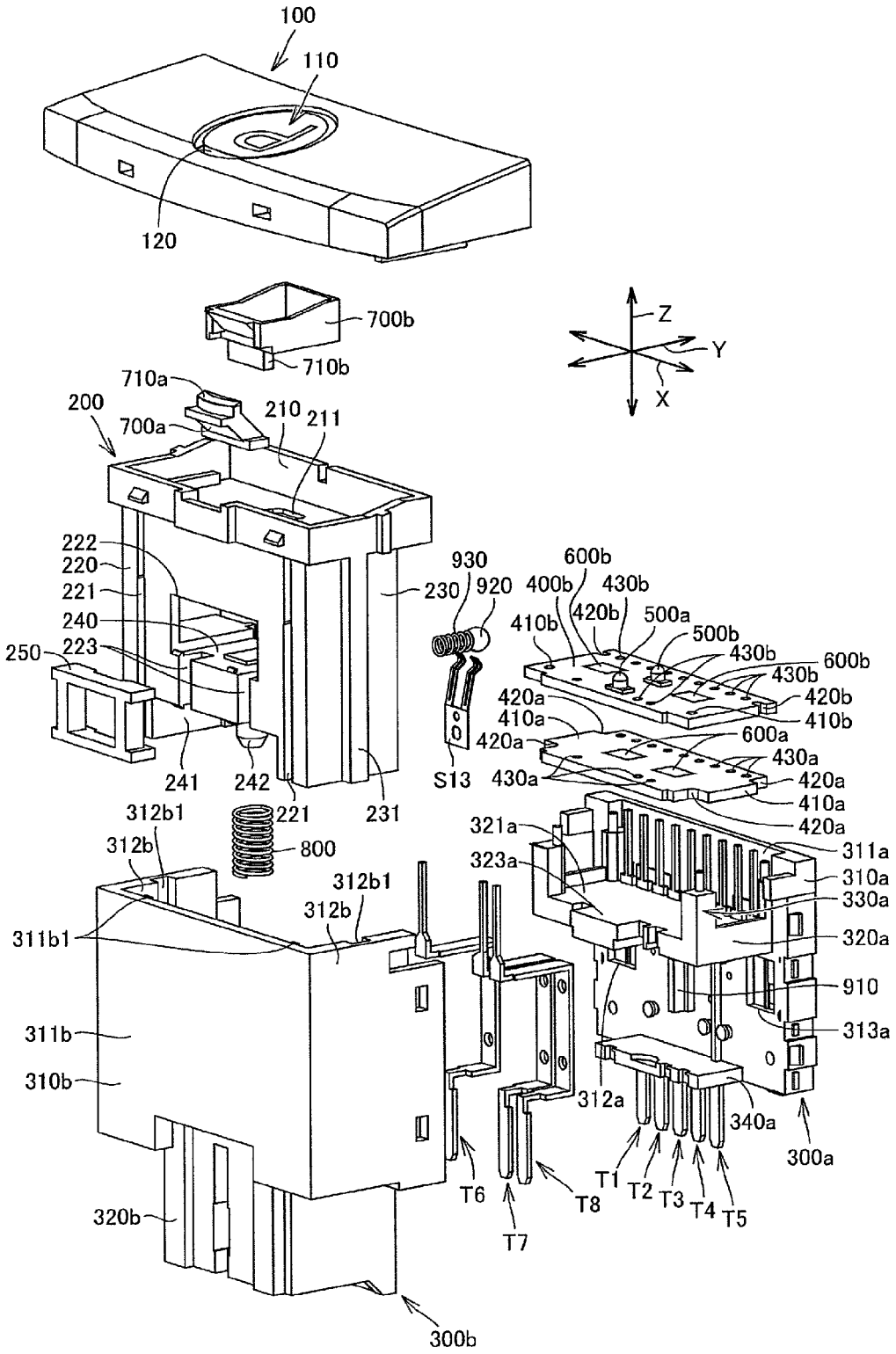
FIG. 3A is an exploded perspective view of the push switch, as viewed from the front, top, and right side thereof.

The body 300*a* is made of insulating plastic material. As illustrated in FIGS. 3A to 4, the body 300*a* includes a main body 310*a*, a first holder 320*a*, a second holder 330*a*, and a third holder 340*a*.

The main body 310*a* is a generally rectangular plate. A generally rectangular recess 311*a* is provided on the upper end (the end on a first side in the first direction Z) of the inner face of the main body 310*a*. The recess 311*a* opens upward (toward the first side in the first direction Z). Generally rectangular recesses 312*a* and 313*a* are provided below the recess 311*a* (on a second side in the first direction Z), on opposite ends in the second direction X of the inner face of the main body 310*a*.

As illustrated in FIGS. 2A to 2D and FIG. 4, the first holder 320*a* includes a plate 321*a*, a pair of pedestals 322*a*, and a stop 323*a*. The plate 321*a* is a generally rectangular plate extends in the third direction Y, integrally formed with a portion between the recess 311*a* and the recesses 312*a* and 313*a* of the inner face of the main body 310*a*. The pedestals 322*a* are rectangular prisms extend in the third direction Y on opposite ends in the second direction X of the plate 321*a*. The stop 323*a* is a generally rectangular projection in the center of a distal end face (an end face on the first side in the third direction Y) of the plate 321*a*. An attaching recess 321*a*1 is provided in the distal end face of the plate 321*a*, on a first side in the second direction X with respect to the stop 323*a*. Attaching recesses 321*a*2 and 321*a*3 are also provided in spaced relation to each other in the second direction X, on a second side in the second direction X with respect to the stop 323*a* in the distal end face of the plate 321*a*.

The second holding 330*a* has four pillars 331*a*. The pillars 331*a* are square poles that stand on respective four corners of the plate 321*a* and extend toward the first side in the first direction Z. Two of the pillars 331*a* are located on opposite sides in the third direction Y of one of the pair of pedestals 322*a* on the first side in the second direction X. The other two of the pillars 331*a* are located on opposite ends in the third direction Y of the other pedestal 322*a* on the second side in the second direction X. Projections 331*a*1 are formed on respective upper end faces (faces on the first side in the first direction Z) of the pillars 331*a*.

The third holder 340*a* is a generally rectangular plate extends in the third direction Y, integrally formed with the lower end (the end on the second side in the first direction Z) of the inner face of the main body 310*a*. The third holder 340*a* is provided with a housing recess 341*a*. An attaching recess 342*a* is provided in the distal end face (the end face on the first side in the third direction Y) of the third holder 340*a*, on the first side in the second direction X with respect to the housing recess 341*a*. Attaching recesses 343*a* and 344*a* are provided in spaced relation to each other in the second direction X, on the second side in the second direction X with respect to the housing recess 341*a* in the distal end face of the third holder 340*a*. The attaching recess 342*a* is located on the vertical line passing through the attaching recess 321*a*1. The attaching recess 343*a* is located on the vertical line passing through the attaching recess 321*a*2, and the attaching recess 344*a* is located on the vertical line passing through the attaching recess 321*a*3.

As illustrated in FIGS. 2A to 4, the first circuit board 400*a* is held by the first holder 320*a*. The first circuit board 400*a* includes a pair of protrusions 410*a*, four guide recesses 420*a*, a plurality of through-hole electrodes 430*a*, and a plurality of conductive lines (not shown). The protrusions 410*a* are generally rectangular plates protrude from centers of opposite ends in the second direction X of the first circuit board 400*a*. The dimension in the third direction Y of each protrusion 410*a* is substantially the same as the distance between two pillars 331*a* arranged in the third direction Y. The protrusions 410*a* are placed on the respective pedestals 322*a* of the first holder 320*a* to abut the pillars 331*a*. That is, the positions of the protrusions 410*a* are fixed in position by the pillars 331*a*.

Two of the guide recesses 420*a* are provided on the first side in the second direction X of the first circuit board 400*a*, more particularly on opposite sides in the third direction Y of one of the protrusions 410*a* on the first side in the second direction X. The other two guide recesses 420*a* are provided on the second side in the second direction X of the first circuit board 400*a*, more particularly on opposite sides in the third direction Y of the other protrusion 410*a* on the second side in the second direction X. The guide recesses 420*a* are of shape corresponding to the outer shapes of the pillars 331*a*. The pillars 331*a* fit in the respective guide recesses 420*a* so as to be movable in the first direction Z.

Figure 3B:
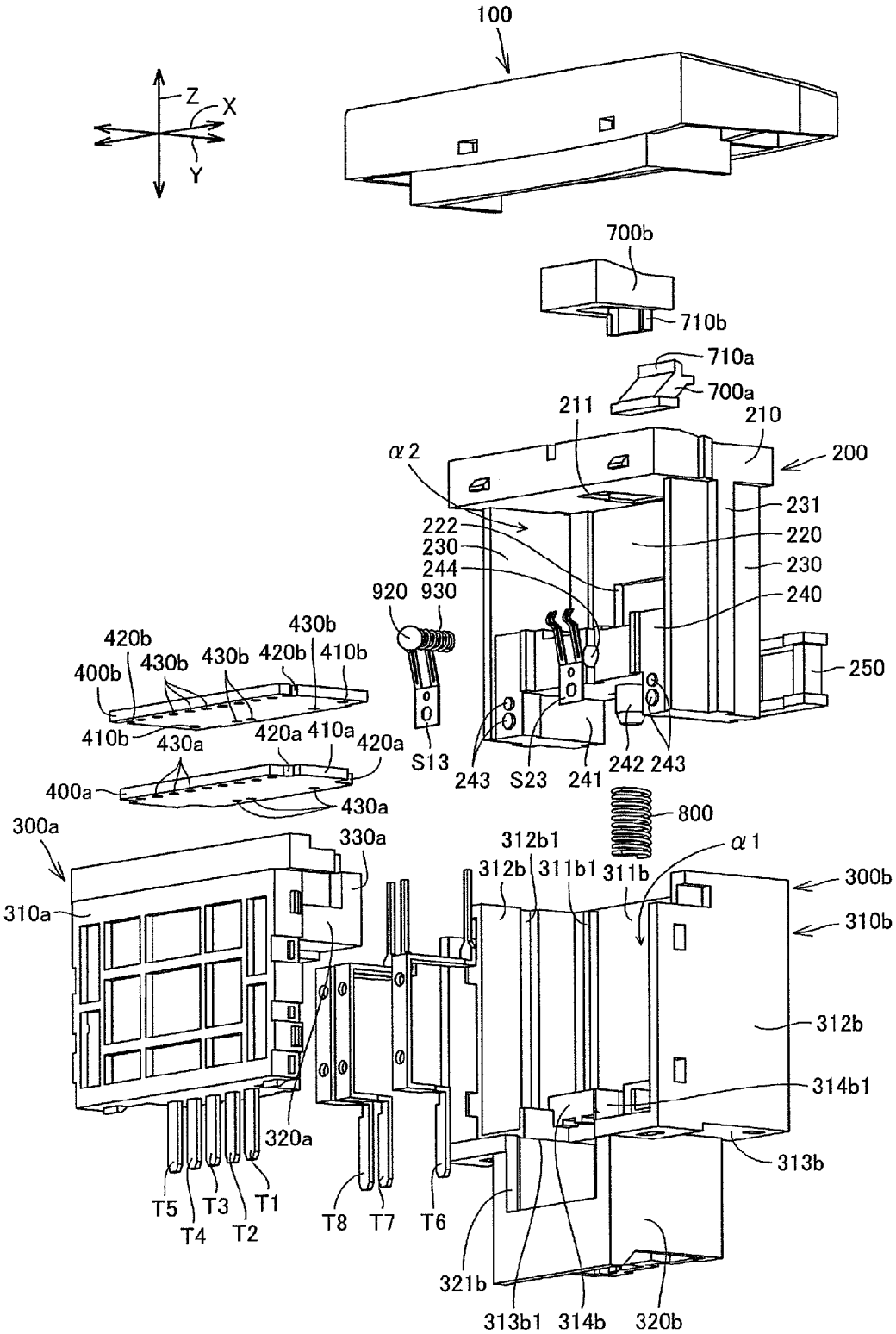
FIG. 3B is an exploded perspective view of the push switch, as viewed from the back, bottom, and left side thereof.
Figure 4:
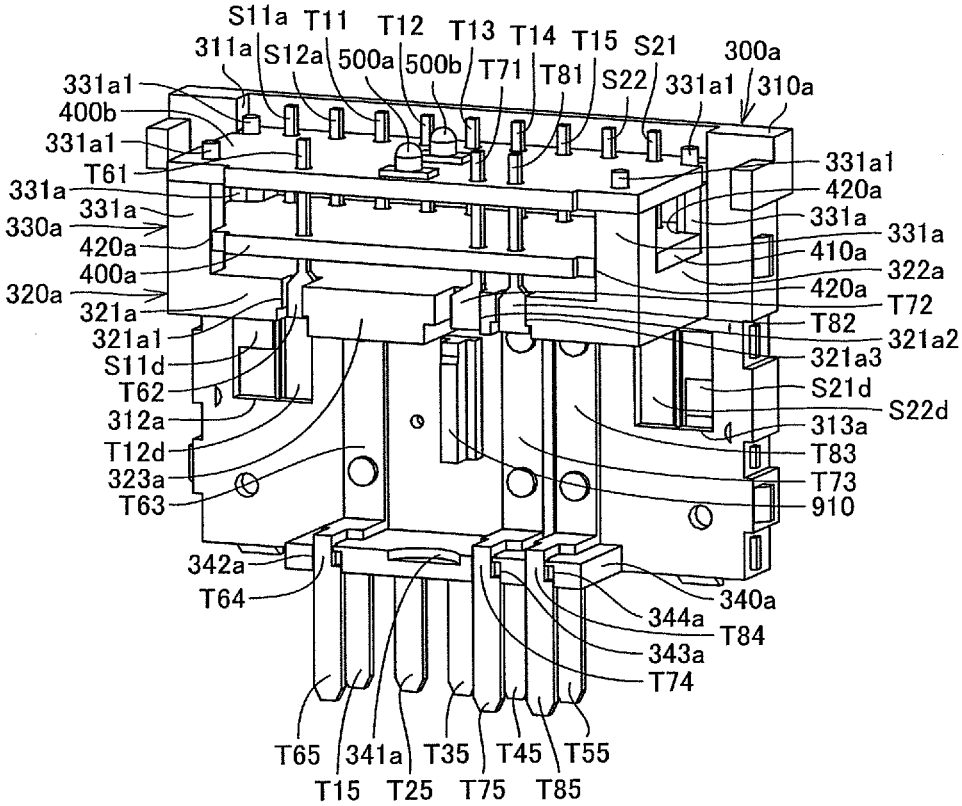
FIG. 4 is a perspective view of a body, fixed contacts of switches, terminals, first and second circuit boards, and electrical components of the push switch, as viewed from the front, top and right side thereof.

As illustrated in FIGS. 3A and 3B, three of the through-hole electrodes 430*a* are arranged at intervals along the second direction X, on a first end portion in the third direction Y of the first circuit board 400*a*. The rest of the through-hole electrodes 430*a* are arranged at intervals along the second direction X, on the second end portion in the third direction Y of the first circuit board 400*a*.

The pair of first circuits 600*a* is provided on the first circuit board 400*a*. One of the first circuits 600*a* (hereinbelow referred to as a first side first circuit 600*a*) is a protection circuit for the switch S1. The other first circuit 600*a* (hereinbelow referred to as a second side first circuits 600*a*) is a protection circuit for the switch S2. The first circuits 600*a* are electrically connected to the through-hole electrodes 430*a* via the conductive lines of the first circuit board 400*a*.

As illustrated in FIGS. 2A to 4, the second circuit board 400*b* is held by the second holder 330*a*. The second circuit board 400*b* is spaced from the first circuit board 400*a* in the first direction Z. The second circuit board 400*b* includes a pair of fitting holes 410*b*, a pair of fitting recesses 420*b*, a plurality of through-hole electrodes 430*b*, and a plurality of conductive lines (not shown). The fitting holes 410*b* are provided at opposite corners of the first side of the third direction Y of the second circuit board 400*b*. The fitting recesses 420*b* are provided at opposite corners of the second side of the third direction Y of the second circuit board 400*b*. The fitting holes 410*b* and the fitting recesses 420*b* receive the projections 331*a*1 of the second holder 330*a* such that the second circuit board 400*b* is held on the pillars 331*a* of the second holder 330*a*. The second circuit board 400*b* thus held is located on the first side in the Z direction the first circuit board 400*a*, with a space therebetween.

Three of the through-hole electrodes 430*b* are arranged at intervals along the second direction X, on a first end portion in the third direction Y of the second circuit board 400*b*. The centers of the three thorough-hole electrodes 430*b* are located above the respective three through-hole electrodes 430*a*, i.e. on the vertical lines passing through the centers of the respective three through-hole electrodes 430*a*. The rest of the through-hole electrodes 430*b* are arranged at intervals along the second direction X, on the second end portion in the third direction Y of the second circuit board 400*b*. The centers of these through-hole electrodes 430*b* are located above the respective rest of the through-hole electrodes 430*a*, i.e. on the vertical lines passing through the centers of the respective rest of the through-hole electrodes 430*a*.

The electronic components 500*a* and 500*b* and the pair of second circuits 600*b* are provided on the second circuit board 400*b*. The electronic components 500*a* and 500*b* are light emitting diodes (LEDs). One of the second circuits 600*b* (hereinbelow referred to as a first side second circuit 600*b*) is an illumination circuit for turning on the electronic component 500*a* when the switch S1 is turned on. The other second circuit 600*b* (hereinbelow referred to as a second side second circuit 600*b*) is an illumination circuit for turning on the electronic component 500*b* when the switch S2 is turned on. The conductive lines of the second circuit board 400*b* serve to electrically connect between the electronic components 500*a* and 500*b* and the through-hole electrodes 430*b*, between the electronic components 500*a* and 500*b* and the second circuits 600*b*, and between the through-hole electrodes 430*b* and the second circuits 600*b*.

The switch S1 is a normally closed switch. As illustrated in FIGS. 3A to 5B, the switch S1 includes first and second fixed contacts S11 and S12 and a movable contact S13. The first and second fixed contacts S11 and S12 are terminals formed of metal plates. The movable contact S13 is a slider formed of a metal plate.

Figure 5A:
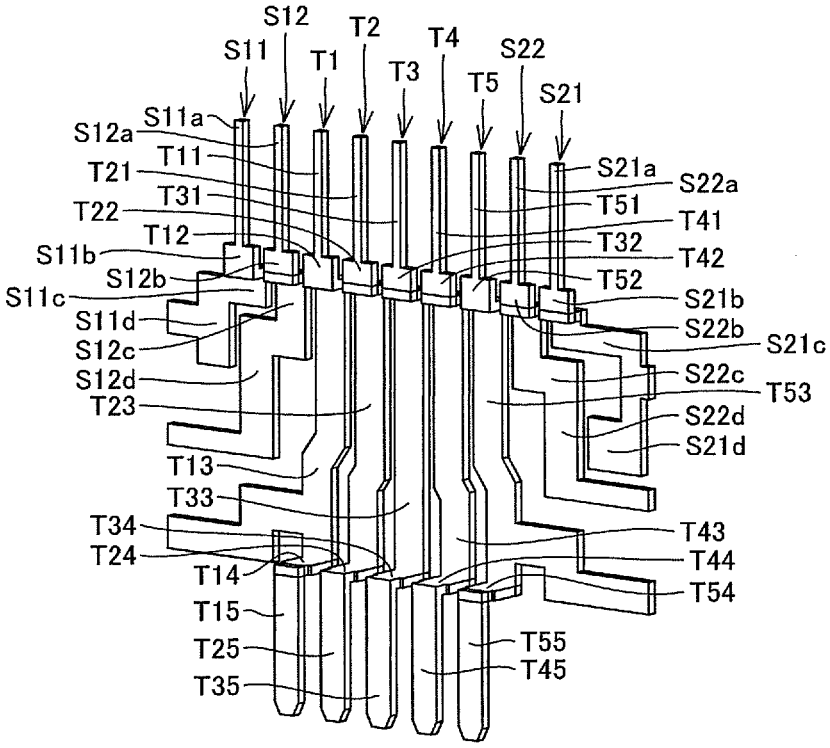
FIG. 5A is a perspective view of the fixed contacts and the terminals of the push switch, as viewed from the front, top, and right side thereof.
Figure 5B:
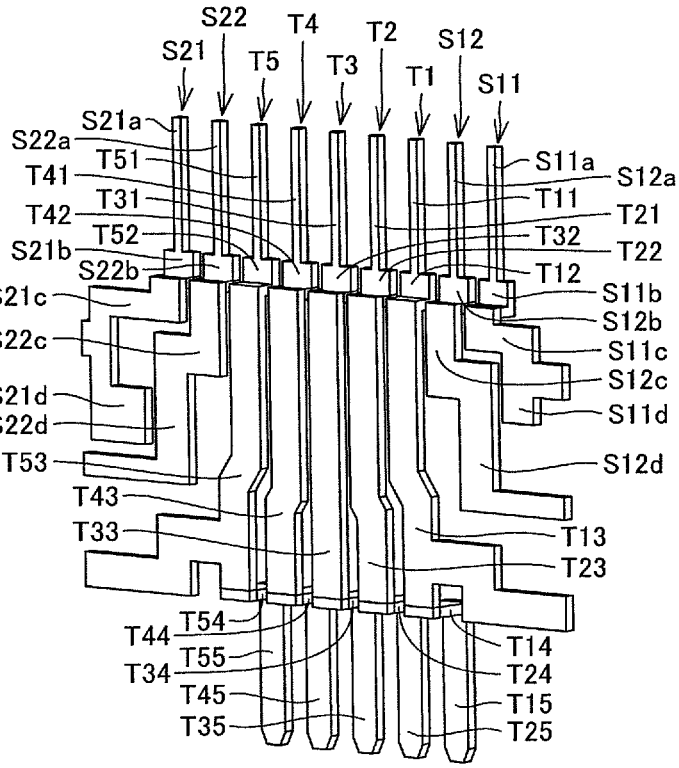
FIG. 5B is a back, top, and left side perspective view of the fixed contacts and the terminals of the push switch.

As illustrated in FIGS. 5A and 5B, the first fixed contact S11 includes a connection portion S11*a*, a bent portion S11*b*, an embedded portion S11*c*, and a contact portion S11*d*. The embedded portion S11*c* is a generally L-shaped plate consisting of a first plate and a second plate. The first plate of the embedded portion S11*c* extends in the first direction Z. The second plate of the embedded portion S11*c* extends contiguously from the lower end of the first plate of the embedded portion S11*c* to the first side in the second direction X. The embedded portion S11*c* is embedded in the main body 310*a*.

The bent portion S11*b* is a generally L-shaped plate consisting of a first plate and a second plate. The first plate of the bent portion S11*b* extends contiguously from the upper end (the first end in the first direction Z) of the first plate of the embedded portion S11*c* to the first side in the third direction Y. The first plate of the bent portion S11*b* is embedded in the main body 310*a*. The second plate of the bent portion S11*b* extends contiguously from the first plate of the bent portion S11*b* to the first side in the first direction Z. The lower end of the second plate of the bent portion S11*b* is embedded in the main body 310*a*. The upper end of the second plate of the bent portion S11*b* protrudes upward from the main body 310*a* to be located inside the recess 311*a* of the main body 310*a*.

The connection portion S11*a* is a square pole extending in the first direction Z from the upper end (the first end in the first direction Z) of the second plate of the bent portion S11*b*. As illustrated in FIG. 4, the connection portion S11*a* is disposed inside the recess 311*a* of the main body 310*a* (but actually outside the body 300*a*). The connection portion S11*a* is inserted through and soldered to the corresponding through-hole electrode 430*a* of the first circuit board 400*a* and the corresponding through-hole electrode 430*b* of the second circuit board 400*b*. The first fixed contact S11 is thus electrically connected to the first and second circuit boards 400*a* and 400*b*, the first side first circuit 600*a*, the first side second circuit 600*b*, and the electronic component 500*a*.

Figure 2A:
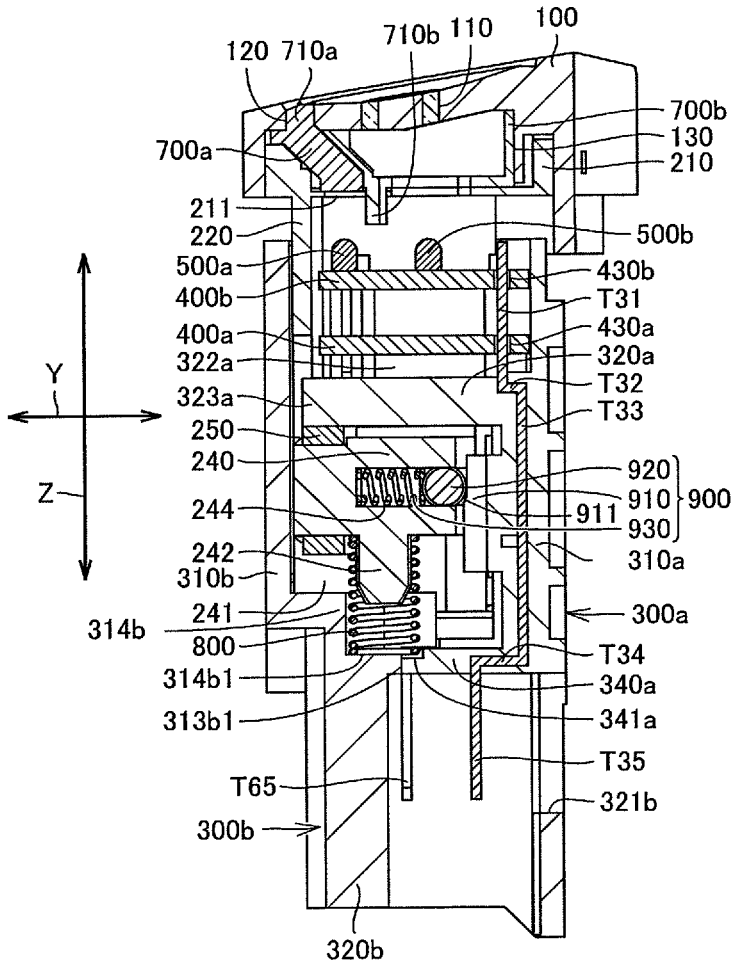
FIG. 2A is a cross-sectional view of the push switch with a keytop in an initial state, taken along line 2A-2A in FIG. 1A.
Figure 2B:
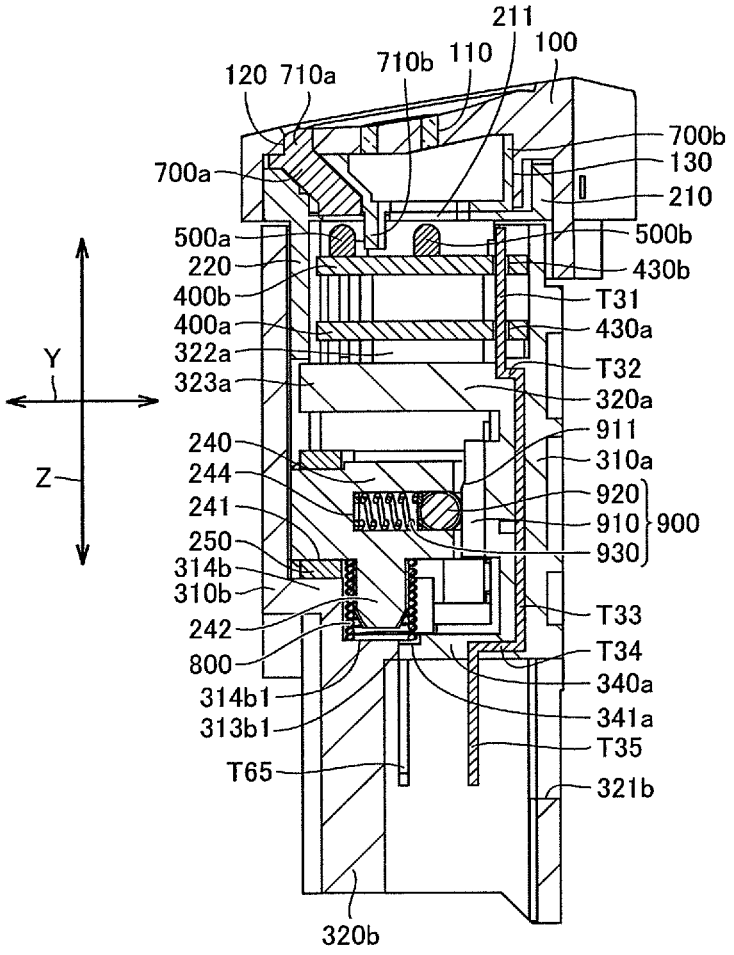
FIG. 2B is a cross-sectional view of the push switch with the keytop in a depressed state, i.e. the state where the keytop is depressed, taken along line 2A-2A in FIG. 1A.
Figure 2C:
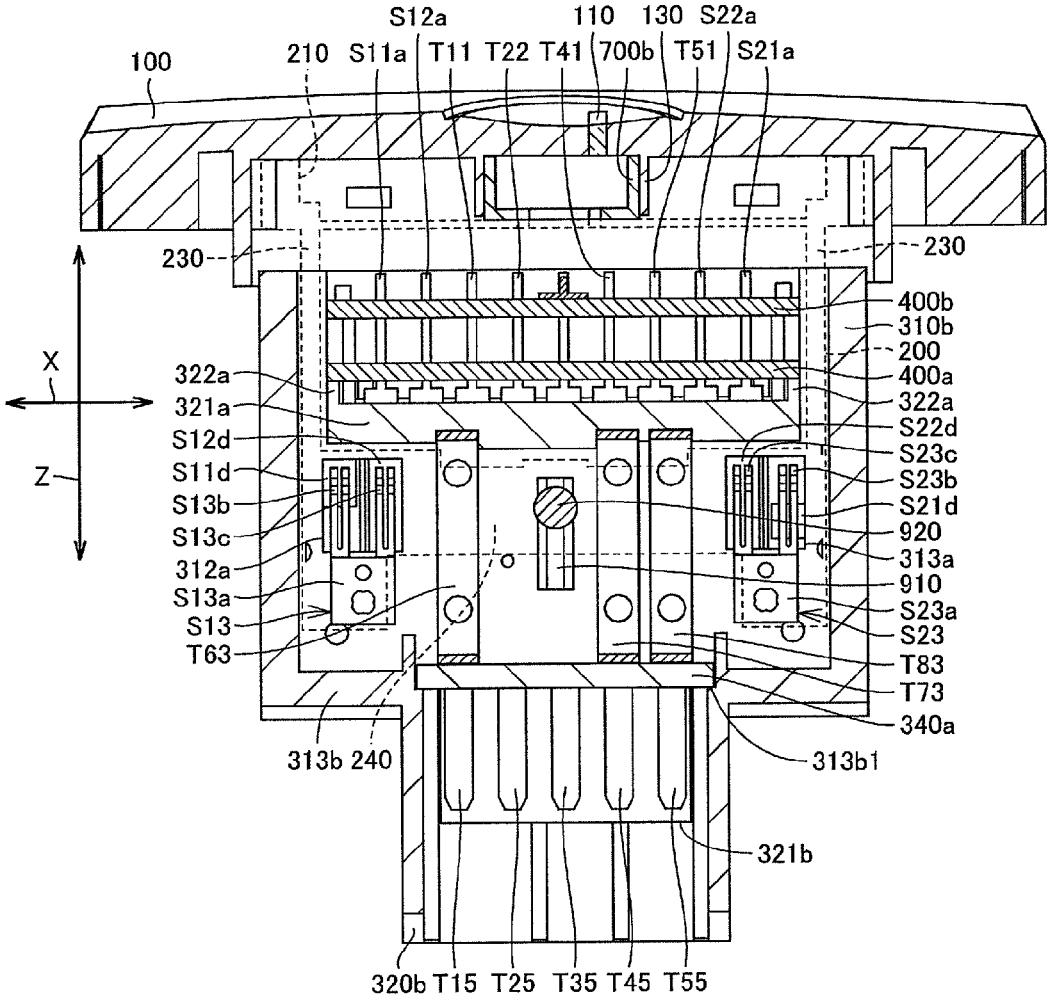
FIG. 2C is a cross-sectional view of the push switch with the keytop in the initial state, taken along line 2C-2C in FIG. 1A.
Figure 2D:
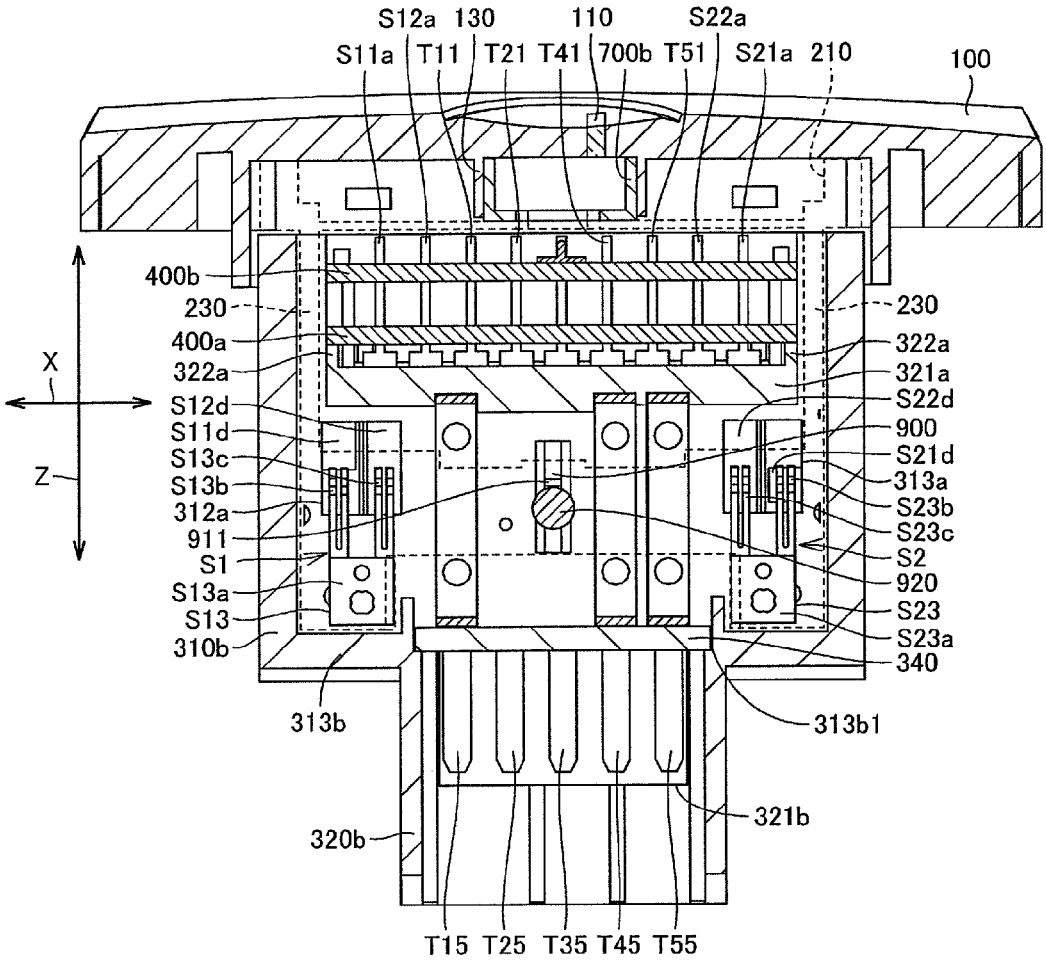
FIG. 2D is a cross-sectional view of the push switch with the keytop in the depressed state, taken along line 2C-2C in FIG. 1A.

The contact portion S11*d* is a rectangular plate extending contiguously from the second plate of the embedded portion S11*c* to the lower side (to the second side in the first direction Z). As illustrated in FIGS. 2C and 2D, the contact portion S11*d* is partially embedded in the main body 310*a* and partially exposed on the bottom of the recess 312*a* of the main body 310*a*.

As illustrated in FIGS. 5A and 5B, the second fixed contact S12 includes a connection portion S12*a*, a bent portion S12*b*, an embedded portion S12*c*, and a contact portion S12*d*. The embedded portion S12*c* is a generally L-shaped plate consisting of a first plate and a second plate. The first plate of the embedded portion S12*c* extends in the first direction Z. The first plate of the embedded portion S12*c* has a larger dimension in the first direction Z than the first plate of the embedded portion S11*c*. The second plate of the embedded portion S12*c* extends contiguously from the first plate of the embedded portion S12*c* to the first side in the second direction X. The embedded portion S12*c* is embedded in the main body 310*a* to be located on the second side in the second direction X with respect to the embedded portion S11*c* and the contact portion S11*d*.

The bent portion S12*b* is a generally L-shaped plate consisting of a first plate and a second plate. The first plate of the bent portion S12*b* extends contiguously from the upper end (the first end in the first direction Z) of the first plate of the embedded portion S12*c* to the first side in the third direction Y. The first plate of the bent portion S12*b* is embedded in the main body 310*a* so as to be located on the second side in the second direction X with respect to the first plate of the bent portion S11*b*. The second plate of the bent portion S12*b* extends contiguously from the first plate of the bent portion S12*b* to the first side in the Z direction. The lower end of the second plate of the bent portion S12*b* is embedded in the main body 310*a* so as to be located on the second side in the second direction X with respect to the lower end of the second plate of the bent portion S11*b*. The upper end of the second plate of the bent portion S12*b* protrudes upward from the main body 310*a* to be located inside the recess 311*a* of the main body 310*a*, more particularly on the second side in the second direction X with respect to the upper end of the second plate of the bent portion S11*b*.

The connection portion S12*a* is a square pole extending in the first direction Z from the upper end (the first end in the first direction Z) of the second plate of the bent portion S12*b*. The connection portion S12*a* is disposed inside the recess 311*a* of the main body 310*a* (but actually outside the body 300*a*) so as to be located on the second side in the second direction X with respect to the connection portion S11*a*. The connection portion S12*a* is inserted through and soldered to the corresponding through-hole electrode 430*a* of the first circuit board 400*a* and the corresponding through-hole electrode 430*b* of the second circuit board 400*b*. The second fixed contact S12 is thus electrically connected to the first and second circuit boards 400*a* and 400*b*, the first side first circuit 600*a*, the first side second circuit 600*b*, and the electronic component 500*a*.

The contact portion S12*d* is a rectangular plate extending contiguously from the second plate of the embedded portion S12*c* to the lower side (to the second side in the first direction Z). As illustrated in FIGS. 2C and 2D, the contact portion S12*d* is partially embedded in the main body 310*a* and partially exposed on the bottom of the recess 312*a* of the main body 310*a*. The contact portion S12*d* is located on the second side in the second direction X with respect to the contact portion S11*d*. The contact portion S12*d* is has a larger dimension in the first direction Z than the contact portion S11*d*. That is, the contact portion S12*d* extends further than the contact portion S11*d* to the second side in the first direction Z.

As illustrated in FIGS. 2C to 3B, the movable contact S13 includes a fixed plate S13*a*, and sliding arms S13*b* and S13*c*. The fixed plate S13*a* is a rectangular plate fixed to the slider 200. The sliding arms S13*b* and S13*c* are contiguous with the fixed plate S13*a* and extend in substantially parallel to each other. Each of the sliding arms S13*b* and S13*c* has a distal end curved in an arc shape. The movable contact S13 in an initial position is located as illustrated in FIG. 2C. Particularly, the distal end of the sliding arm S13*b* is in contact with the contact portion S11*d* of the first fixed contact S11, and the distal end of the sliding arm S13*c* is in contact with the contact portion S12*d* of the second fixed contact S12. In this arrangement, the switch S1 is on to make the first side second circuit 600*b* glow the electronic component 500*a*. When the keytop 100 and the slider 200 move, the movable contact S13 accordingly moves from the initial position to a moved position, and the distal ends of the sliding arms S13*b* and S13*c* slide along the bottom of the recess 312*a*. When the movable contact S13 is located at the moved position as illustrated in FIG. 2D, the distal end of the sliding arm S13*c* maintains the contact with the contact portion S12*d* of the second fixed contact S12. On the other hand, the distal end of the sliding arm S13*b* is brought out of contact with the contact portion S11*d* of the first fixed contact S11. In this arrangement, the switch S1 is turned off to make the first side second circuit 600*b* turn off the electronic component 500*a*.

The switch S2 is a normally open switch. As illustrated in FIGS. 3A to 5B, the switch S2 includes first and second fixed contacts S21 and S22, and a movable contact S23. The first and second fixed contacts S21 and S22 are terminals formed of metal plates.

As illustrated in FIGS. 5A and 5B, the first fixed contact S21 has substantially the same shape as the first fixed contact S11, except that an embedded portion S21*c* and a contact portion S21*d* of the first fixed contact S21 are different in shape from the embedded portion S11*c* and the contact portion S11*d*, respectively, of the first fixed contact S11 of the switch S1. A connection portion S21*a* is inserted through and soldered to the corresponding through-hole electrode 430*a* of the first circuit board 400*a* and the corresponding through-hole electrode 430*b* of the second circuit board 400*b*. The first fixed contact S21 is thus electrically connected to the first and second circuit boards 400*a* and 400*b*, the second side first circuit 600*a*, the second side second circuit 600*b*, and the electronic component 500*b*. A bent portion S21*b* of the first fixed contact S21 is illustrated in FIGS. 5A and 5B.

The embedded portion S21*c* is a plate consisting of a first plate, a second plate, and a third plate. The first plate of the embedded portion S21*c* extends in the first direction Z. The second plate of the embedded portion S21*c* extends contiguously from the lower end of the first plate of the embedded portion S21*c* to the second side in the second direction X. The third plate of the embedded portion S21*c* extends contiguously from the second end in the second direction X of the second plate of the embedded portion S21*c* to the lower side (to the second side in the first direction Z). The embedded portion S21*c* is embedded in the main body 310*a*.

The contact portion S21*d* is a rectangular plate extending contiguously from the lower end of the third plate of the embedded portion S21*c* to the first side in the second direction X. As illustrated in FIGS. 2C and 2D, the contact portion S21*d* is partially embedded in the main body 310*a* and partially exposed on the bottom of the recess 313*a* of the main body 310*a*.

As illustrated in FIGS. 5A and 5B, the second fixed contact S22 has a generally symmetrical shape to the second fixed contact S12. An embedded portion S22*c* of the second fixed contact S22 is embedded in the main body 310*a* so as to be located on the first side in the second direction X with respect to the embedded portion S21*c*. A bent portion S22*b* of the second fixed contact S22 is embedded in the main body 310*a* such that the lower ends of first and second plates are located on the first side in the second direction X with respect to the lower ends of the first and second plates, respectively, of the bent portion S21*b*. The upper end of the second plate of the bent portion S22*b* protrudes upward from the main body 310*a* to be located inside the recess 311*a* of the main body 310*a* and on the first side in the second direction X with respect to the upper end of the second plate of the bent portion S21*b*. A connection portion S22*a* of the second fixed contact S22 is located inside the recess 311*a* of the main body 310*a* (but actually outside the body 300*a*) and on the first side in the second direction X with respect to the connection portion S21*a*. The connection portion S22*a* is inserted through and soldered to the corresponding through-hole electrode 430*a* of the first circuit board 400*a* and the corresponding through-hole electrode 430*b* of the second circuit board 400*b*. The second fixed contact S22 is thus electrically connected to the first and second circuit boards 400*a* and 400*b*, the second side first circuit 600*a*, the second side second circuit 600*b*, and the electronic component 500*b*. As illustrated in FIGS. 2C and 2D, a contact portion S22*d* of the second fixed contact S22 is partially embedded in the main body 310*a* and partially exposed on the bottom of the recess 313*a* of the main body 310*a*. The contact portion S22*d* is located on the first side in the second direction X with respect to the contact portion S21*d*.

As illustrated in FIGS. 2C and 2D, the movable contact S23 has the same configuration as the movable contact S13 of the switch S1. The movable contact S23 in an initial position is located as illustrated in FIG. 2C. Particularly, the distal end of a sliding arm S23*c* is in contact with the contact portion S22*d* of the second fixed contact S22. On the other hand, the distal end of a sliding arm S23*b* is not in contact with the contact portion S21*d* of the first fixed contact S21. In this arrangement, the switch S2 is off to make the second side second circuit 600*b* maintains the electronic component 500*b* in an off state. When the keytop 100 and the slider 200 move, the movable contact S23 accordingly moves from the initial position to a moved position, and the distal ends of the sliding arms S23*b* and S23*c* slide along the bottom of the recess 313*a*. When the movable contact S23 is located at the moved position as illustrated in FIG. 2D, the distal end of the sliding arm S23*b* is brought into contact with the contact portion S21*d* of the first fixed contact S21, and the distal end of the sliding arm S23*c* is brought into contact with and the contact portion S22*d* of the second fixed contact S22. This arrangement causes the switch S2 to be turned on to make the second side second circuit 600*b* turn on the electronic component 500*b*. A fixed plate S23*a* of the movable contact S23 is illustrated in FIGS. 2C and 2D.

The terminals T1, T2, T3, T4, and T5 are formed of metal plates. As illustrated in FIG. 4, the terminals T1, T2, T3, T4, and T5 are partially embedded at intervals along the second direction X in the main body 310*a*, between the second fixed contact S12 of the switch S1 and the second fixed contact S22 of the switch S2. In other words, the first fixed contact S11, the second fixed contact S12, the terminals T1, T2, T3, T4, and T5, the second fixed contact S22, and the first fixed contact S21 are arrayed at intervals in this order along the second direction X and partially embedded in the main body 310*a*.

As illustrated in FIGS. 5A and 5B, the terminal T1 includes a connection portion T11, a first bent portion T12, an embedded portion T13, a second bent portion T14, and a tail portion T15. The first bent portion T12 has the same shape as the bent portion S12*b* of the second fixed contact S12 of the switch S1. A first plate of the first bent portion T12 is embedded in the main body 310*a* so as to be located on the second side in the second direction X with respect to the first plate of the bent portion S12*b*. The lower end of a second plate of the first bent portion T12 is embedded in the main body 310*a* so as to be located on the second side in the second direction X with respect to the lower end of the second plate of the bent portion S12*b*. The upper end of the second plate of the first bent portion T12 protrudes upward from the main body 310*a* to be located inside the recess 311*a* of the main body 310*a*, more particularly on the second side in the second direction X with respect to the upper end of the second plate of the bent portion S12*b*.

The connection portion T11 has the same shape as the connection portion S12*a* of the second fixed contact S12 of the switch S1. The connection portion T11 is disposed inside the recess 311*a* of the main body 310*a* (but actually outside the body 300*a*) so as to be located on the second side in the second direction X with respect to the connection portion S12*a*. The connection portion T11 is inserted through and soldered to the corresponding through-hole electrode 430*a* of the first circuit board 400*a* and the corresponding through-hole electrode 430*b* of the second circuit board 400*b*. The terminal T1 is thus electrically connected to the first and second circuit boards 400*a* and 400*b*, the first side second circuit 600*b*, and the electronic component 500*a*. The terminal T1 thus forms part of the first side second circuit 600*b* (illumination circuit) for the electronic component 500*a*.

The embedded portion T13 is a generally rectangular plate extending contiguously from the first bent portion T12 to the lower side (to the second side in the first direction Z). The embedded portion T13 is embedded in the main body 310*a* so as to be located on the second side in the second direction X with respect to the embedded portion S12*c* and the contact portion S12*d* of the second fixed contact S12. The second bent portion T14 is a rectangular plate extending contiguously from the lower end of the embedded portion T13 to the first side in the third direction Y. The second bent portion T14 is embedded in the main body 310*a* and the third holder 340*a*. The tail portion T15 is a generally rectangular plate extending contiguously from the first end in the third direction Y of the second bent portion T14 to the lower side (to the second side in the first direction Z). The tail portion T15 protrudes from the third holder 340*a* to the lower side (to the second side in the first direction Z).

As illustrated in FIGS. 5A and 5B, the terminal T2 includes a connection portion T21, a first bent portion T22, an embedded portion T23, a second bent portion T24, and a tail portion T25. The first bent portion T22 has the same shape as the bent portion S12*b* of the second fixed contact S12 of the switch S1. A first plate of the first bent portion T22 is embedded in the main body 310*a* so as to be located on the second side in the second direction X with respect to the first plate of the first bent portion T12. The lower end of a second plate of the first bent portion T22 is embedded in the main body 310*a* so as to be located on the second side in the second direction X with respect to the lower end of the second plate of the first bent portion T12. The upper end of the second plate of the first bent portion T22 protrudes upward from the main body 310*a* to be located inside the recess 311*a* of the main body 310*a*, more particularly on the second side in the second direction X with respect to the upper end of the second plate of the first bent portion T12.

The connection portion T21 has the same shape as the connection portion S12*a* of the second fixed contact S12 of the switch S1. The connection portion T21 is disposed inside the recess 311*a* of the main body 310*a* (but actually outside the body 300*a*) so as to be located on the second side in the second direction X with respect to the connection portion T11. The connection portion T21 is inserted through and soldered to the corresponding through-hole electrode 430*a* of the first circuit board 400*a* and the corresponding through-hole electrode 430*b* of the second circuit board 400*b*. The terminal T2 is thus electrically connected to the first and second circuit boards 400*a* and 400*b*, the first side second circuit 600*b*, and the electronic component 500*a*. The terminal T2 thus forms part of the first side second circuit 600*b* (illumination circuit) for the electronic component 500*a*.

The embedded portion T23 is a generally rectangular plate extending contiguously from the first bent portion T22 to the lower side (to the second side in the first direction Z). The embedded portion T23 is embedded in the main body 310*a* so as to be located on the second side in the second direction X with respect to the embedded portion T13 of the terminal T1. The second bent portion T24 is a rectangular plate which is connected to the lower end of the embedded portion T23 and extends toward the first side in the third direction Y. The second bent portion T24 is embedded in the main body 310*a* and the third holder 340*a* so as to be located on the second side in the second direction X with respect to the second bent portion T14 of the terminal T1. The tail portion T25 is a generally rectangular plate extending contiguously from the first end in the third direction Y of the second bent portion T24 to the lower side (to the second side in the first direction Z). The tail portion T25 protrudes from the third holder 340*a* to the lower side (to the second side in the first direction Z). The tail portion T25 is located on the second side in the second direction X with respect to the tail portion T15 of the terminal T1.

As illustrated in FIGS. 5A and 5B, the terminal T3 includes a connection portion T31, a first bent portion T32, an embedded portion T33, a second bent portion T34, and a tail portion T35. The first bent portion T32 has the same shape as the bent portion S12*b* of the second fixed contact S12 of the switch S1. A first plate of the first bent portion T32 is embedded in the main body 310*a* so as to be located on the second side in the second direction X with respect to the first plate of the first bent portion T22. The lower end of a second plate of the first bent portion T32 is embedded in the main body 310*a* so as to be located on the second side in the second direction X with respect to the lower end of the second plate of the first bent portion T22. The upper end of the second plate of the first bent portion T32 protrudes upward from the main body 310*a* to be located inside the recess 311*a* of the main body 310*a*, more particularly, on the second side in the second direction X with respect to the upper end of the second plate of the first bent portion T22.

The connection portion T31 has the same shape as the connection portion S12*a* of the second fixed contact S12 of the switch S1. The connection portion T31 is disposed inside the recess 311*a* of the main body 310*a* (but actually outside the body 300*a*) so as to be located on the second side in the second direction X with respect to the connection portion T21. The connection portion T31 is inserted through and soldered to the corresponding through-hole electrode 430*a* of the first circuit board 400*a* and the corresponding through-hole electrode 430*b* of the second circuit board 400*b*. The terminal T3 is thus electrically connected to the first and second circuit boards 400*a* and 400*b*, the first side first circuit 600*a*, and the electronic component 500*a*. The terminal T3 thus forms part of the first side first circuit 600*a* (protection circuit) for the switch S1.

The embedded portion T33 is a generally rectangular plate extending contiguously from the first bent portion T32 to the lower side (to the second side in the first direction Z). The embedded portion T33 is embedded in the main body 310*a* so as to be located on the second side in the second direction X with respect to the embedded portion T23 of the terminal T2. The second bent portion T34 is a rectangular plate extending contiguously from the lower end of the embedded portion T33 to the first side in the third direction Y. The second bent portion T34 is embedded in the main body 310*a* and the third holder 340*a* so as to be located on the second side in the second direction X with respect to the second bent portion T24 of the terminal T2. The tail portion T35 is a generally rectangular plate extending contiguously from the first end in the third direction Y of the second bent portion T34 to the lower side (to the second side in the first direction Z). The tail portion T35 protrudes from the third holder 340*a* to the lower side (to the second side in the first direction Z). The tail portion T35 is located on the second side in the second direction X with respect to the tail portion T25 of the terminal T2.

As illustrated in FIGS. 5A and 5B, the terminal T4 has a generally symmetrical shape to the terminal T2. A first plate of a first bent portion T42 of the terminal T4 is embedded in the main body 310*a* so as to be located on the second side in the second direction X with respect to the first plate of the first bent portion T32. The lower end of a second plate of the first bent portion T42 is embedded in the main body 310*a* so as to be located on the second side in the second direction X with respect to the lower end of the second plate of the first bent portion T32. The upper end of the second plate of the first bent portion T42 protrudes upward from the main body 310*a* to be located inside the recess 311*a* of the main body 310*a*, more particularly on the second side in the second direction X with respect to the upper end of the second plate of the first bent portion T32.

A connection portion T41 of the terminal T4 is disposed inside the recess 311*a* of the main body 310*a* (but actually outside the body 300*a*) so as to be located on the second side in the second direction X with respect to the connection portion T31. The connection portion T41 is inserted through and soldered to the corresponding through-hole electrode 430*a* of the first circuit board 400*a* and the corresponding through-hole electrode 430*b* of the second circuit board 400*b*. The terminal T4 is thus electrically connected to the first and second circuit boards 400*a* and 400*b*, the first side first circuit 600*a*, and the electronic component 500*a*. The terminal T4 thus forms part of the first side first circuit 600*a* (protection circuit) for the switch S1.

An embedded portion T43 of the terminal T4 is embedded in the main body 310*a* so as to be located on the second side in the second direction X with respect to the embedded portion T33 of the terminal T3. A second bent portion T44 of the terminal T4 is embedded in the main body 310*a* and the third holder 340*a* so as to be located on the second side in the second direction X with respect to the second bent portion T34 of the terminal T3. A tail portion T45 of the terminal T4 protrudes from the third holder 340*a* to the lower side (to the second side in the first direction Z). The tail portion T45 is located on the second side in the second direction X with respect to the tail portion T35 of the terminal T3.

As illustrated in FIGS. 5A and 5B, the terminal T5 has a generally symmetrical shape to the terminal T1. A first plate of a first bent portion T52 of the terminal T5 is embedded in the main body 310*a* so as to be located on the second side in the second direction X with respect to the first plate of the first bent portion T42. The lower end of a second plate of the first bent portion T52 is embedded in the main body 310*a* so as to be located on the second side in the second direction X with respect to the lower end of the second plate of the first bent portion T42. The upper end of the second plate of the first bent portion T52 protrudes upward from the main body 310*a* to be located inside the recess 311*a* of the main body 310*a*, more particularly on the second side in the second direction X with respect to the upper end of the first plate of the first bent portion T42.

A connection portion T51 of the terminal T5 is disposed inside the recess 311*a* of the main body 310*a* (but actually outside the body 300*a*) so as to be located on the second side in the second direction X with respect to the connection portion T41. The connection portion T51 is inserted through and soldered to the corresponding through-hole electrode 430*a* of the first circuit board 400*a* and the corresponding through-hole electrode 430*b* of the second circuit board 400*b*. The terminal T5 is thus electrically connected to the first and second circuit boards 400*a* and 400*b*, the second side first circuit 600*a* and the electronic component 500*b*. The terminal T5 thus forms part of the first side first circuit 600*a* (protection circuit) for the switch S2.

An embedded portion T53 of the terminal T5 is embedded in the main body 310*a* so as to be located on the second side in the second direction X with respect to the embedded portion T43 of the terminal T4. A second bent portion T54 of the terminal T5 is embedded in the main body 310*a* and the third holder 340*a* so as to be located on the second side in the second direction X with respect to the second bent portion T44 of the terminal T4. A tail portion T55 of the terminal T5 protrudes from the third holder 340*a* to the lower side (to the second side in the first direction Z). The tail portion T55 is located on the second side in the second direction X with respect to the tail portion T45 of the terminal T4.

The terminal T6 is a metal plate as illustrated in FIGS. 3A to 4. The terminal T6 includes a connection portion T61, a first bent portion T62, a fixed portion T63, a second bent portion T64, and a tail portion T65. The fixed portion T63 is a rectangular plate extending in the first direction Z. The fixed portion T63 is welded to a boss on the inner face of the main body 310*a*. The first bent portion T62 is a generally L-shaped plate consisting of a first plate and a second plate. The first plate of the first bent portion T62 extends contiguously from the upper end of the fixed portion T63 to the first side in the third direction Y. The second plate of the first bent portion T62 extends contiguously from the first plate of the first bent portion T62 to the upper side (to the first side in the first direction Z). The second plate of the first bent portion T62 fits in the attaching recess 321*a*1 of the first holder 320*a*.

The connection portion T61 is a square pole extending to the first side in the first direction Z from the upper end (the first end in the first direction Z) of the second plate of the first bent portion T62. The connection portion T61 is inserted through and soldered to the corresponding through-hole electrode 430*a* of the first circuit board 400*a* and the corresponding through-hole electrode 430*b* of the second circuit board 400*b*. The terminal T6 is thus electrically connected to the first and second circuit boards 400*a* and 400*b*, the second side first circuit 600*a*, and the electronic component 500*b*. The terminal T6 thus forms part of the second side first circuit 600*a* (protection circuit) for the switch S2.

The second bent portion T64 is a generally L-shaped plate consisting of a first plate and a second plate. The first plate of the second bent portion T64 extends contiguously from the lower end of the fixed portion T63 to the first side in the third direction Y. The second plate of the second bent portion T64 extends contiguously from the first plate of the second bent portion T64 to the lower side (to the second side in the first direction Z). The second plate of the second bent portion T64 fits in the attaching recess 342*a* of the third holder 340*a*. The tail portion T65 is a generally rectangular plate extending contiguously from the first end in the third direction Y of the second bent portion T64 to the lower side (to the second side in the first direction Z).

As illustrated in FIGS. 3A to 4, the terminals T7 and T8 are each a metal plate of the same shape as the terminal T6. As illustrated in FIGS. 5A and 5B, the terminal T7 includes a connection portion T71, a first bent portion T72, a fixed portion T73, a second bent portion T74, and a tail portion T75. Similarly, the terminal T8 includes a connection portion T81, a first bent portion T82, a fixed portion T83, a second bent portion T84, and a tail portion T85. The fixed portions T73 and T83 are welded to bosses on the inner face of the main body 310*a*. A second plate of the first bent portion T72 and a second plate of the first bent portion T82 fit in the attaching recess 321*a*2 and the attaching recess 321*a*3, respectively, of the first holder 320*a*. A second plate of the second bent portion T74 and a second plate of the second bent portion T84 fit in the attaching recess 343*a* and the attaching recess 344*a*, respectively, of the third holder 340*a*. The connection portions T71 and T81 are inserted through and soldered to the corresponding through-hole electrodes 430*a* of the first circuit board 400*a* and the corresponding through-hole electrodes 430*b* of the second circuit board 400*b*. The terminals T7 and T8 are thus electrically connected to the first and second circuit boards 400*a* and 400*b*, the second side second circuit 600*b*, and the electronic component 500*b*. The terminals T7 and T8 thus form part of the second side second circuit 600*b* (illumination circuit) for the electronic component 500*b*.

The case 300*b* is attached to the body 300*a*. The case 300*b* is made of insulating plastic material. As illustrated in FIGS. 3A and 3B, the case 300*b* includes a case body 310*b* and a connection portion 320*b*. The case body 310*b* includes a front plate 311*b*, a pair of side plates 312*b*, a bottom plate 313*b*, and a support base 314*b*.

The bottom plate 313*b* is a generally rectangular plate. The bottom plate 313*b* has a rectangular through-hole 313*b*1. The front plate 311*b* of a rectangular shape stands on the front end (the first end in the third direction Y) of the upper face of the bottom 313*b*. A pair of rails 311*b*1 is provided in spaced relation to each other in the second direction X on the inner face of the front plate 311*b*. The rails 311*b*1 are elongated protrusions extending in the first direction Z. The side plates 312*b* of generally rectangular shape stand on opposite ends (opposite ends in the second direction X) of the upper face of the bottom plate 313*b*. The front ends (the ends on the first side in the third direction Y) of the side plates 312*b* are integral with the opposite ends in the second direction X of the front plate 311*b*. The distance between the inner faces of the side plates 312*b* is substantially the same as the dimension in the second direction X of the main body 310*a*, and as the dimension in the second direction X of the slider 200. The inner faces of the side plate 312*b* are each provided with a rail groove 312*b*1 extending in the first direction Z. The rear portions of the side plates 312 are each provided with a plurality of locking holes. These locking holes receive locking claws on opposite ends in the second direction X of the main body 310*a* to attach the case body 310*b* to the main body 310*a*. In this combined state as illustrated in FIGS. 2A to 2D, the third holder 340*a* of the body 300*a* closes the through-hole 313*b*1 of the bottom plate 313*b*. As illustrated in FIG. 3B, the case body 310*b*, the main body 310*a*, and the third holder 340*a* define a first housing space $\alpha$1. The first housing space $\alpha$1 houses the slider 200, the movable contact S13 of the switch S1, the movable contact S23 of the switch S2, and the coil spring 800.

As illustrated in FIGS. 2C and 2D, the support base 314*b* is provided on the bottom plate 313*b* at a position on the first side in the third direction Y with respect to the through-hole 313*b*1. The support base 314*b* has a housing recess 314*b*1 communicating with the housing recess 341*a* of the third holder 340*a*. The housing recesses 341*a* and 314*b*1 securely house a first lengthwise end of the coil spring 800.

As illustrated in FIGS. 2A to 2D, the connection portion 320*b* is a generally square tube on the lower face of the bottom plate 313*b*. The connection portion 320*b* is connectable to a mating connector (not shown). An opening 321*b* is provided on the second side in the third direction Y of the connection portion 320*b*. The opening 321*b* allows the tail portions T15 to T85 of the terminals T1 to T8 into the connection portion 320*b*. The tail portions T15 to T85 are electrically connectable to contacts of the mating connector.

The slider 200 is held by the case 300*b* so as to be slidable in the first direction Z between an home position and a depressed position (both to be described). As illustrated in FIGS. 3A and 3*b*, the slider 200 includes a ceiling 210, a front plate 220, a pair of side plates 230, a bottom 240, and a cushion 250. The slider 200, exclusive of the cushion 250, is made of insulating plastic material.

The front plate 220 is a generally rectangular plate. The side plates 230 are rectangular plates extending contiguously from opposite ends in the second direction X of the front plate 220 to the second side in the third direction Y. The bottom 240 is provided on the lower parts of the inner faces of the front plate 220 and the side plates 230. The ceiling 210 is a generally rectangular cup-shaped member on the upper ends of the front plate 220 and the side plates 230. As illustrated in FIG. 3B, the ceiling 210, the front plate 220, the side plates 230, and the bottom 240 define a second housing space a2. The second housing space a2 houses the first and second holders 320*a* and 330*a*, the first and second circuit boards 400*a* and 400*b*, the electronic components 500*a* and 500*b*, the terminals T6 to T8, and a ball 920 and a coil spring 930 (both to be described) of the tactile feel generator 900.

As illustrated in FIG. 3A, rail grooves 221 extend in the first direction Z on opposite end portions in the second direction X of the outer face of the front plate 220. The outer face of each side plate 230 is provided with a rail 231 extending in the first direction Z. The rails 231 fit in the respective rail grooves 312*b*1 of the case 300*b* so as to be movable in the first direction Z. The rails 311*b*1 of the case 300*b* fit in the respective rail grooves 221 so as to be movable in the first direction Z. The slider 200 is thus movable between the home position and the depressed position.

A rectangular through-hole 222 is provided centrally in the center of the front plate 220. As illustrated in FIGS. 2A and 2B, the though hole 222 receives the stop 323*a* of the first holder 320*a*. Also, as illustrated in FIG. 3A, a pair of attaching grooves 223 extends in the first direction Z under the through-hole 222 on the front plate 220. The attaching grooves 223 communicate with the thorough-hole 222 at each first end in the first direction Z. The second ends of the attaching grooves 223 open to the second side in the first direction Z. The attaching grooves 223 receive end portions in the second direction X of the cushion 250. The cushion 250 is a generally rectangular frame. When the slider 200 is located at the home position as illustrated in FIG. 2A, the cushion 250 elastically abuts the stop 323*a* of the first holder 320*a*. When the slider 200 is located at the depressed position as illustrated in FIG. 2B, the cushion 250 elastically abuts the support base 314*b* of the case 300*b*.

The ceiling 210 has a hole 211. As illustrated in FIGS. 2A and 2B, the hole 211 is located so as to face the electronic components 500*a* and 500*b*. The hole 211 thus passes light emitted by the electronic components 500*a* and 500*b* to the first side in the first direction Z.

As illustrated in FIGS. 3A and 3B, a rectangular housing recess 241 is provided in the lower center of the bottom 240. The housing recess 241 has larger dimensions that the outer dimensions of the support base 314*b* of the case 300*b*. As illustrated in FIG. 2B, when the slider 200 is located at the depressed position, the housing recess 241 houses the support base 314*b*. A columnar projection 242 is provided on the bottom of the housing recess 241. The projection 242 faces the housing recesses 341*a* and 314*b*1. The outer diameter of the projection 242 is slightly smaller than the inner diameter of the coil spring 800. The projection 242 fits in a second lengthwise end of the coil spring 800 that is securely housed in the housing recesses 341*a* and 314*b*1. When the slider 200 is located at the depressed position, the coil spring 800 is compressed between the bottom of the housing recess 241 (the bottom 240) and the bottoms of the housing recesses 341*a* and 314*b*1. The compresses coil spring 800 applies a returning force to the slider 200 to return to the home position.

As illustrated in FIG. 3B, the bottom 240 is provided with bosses 243 on each end portion in the second direction X of the face on the second side in the third direction Y. The bosses 243 are adapted for welding thereto the fixed plates S13*a* of the movable contact S13 of the switch S1 and the fixed plate S23*a* of the movable contact S23 of the switch S2. When the slider 200 is located at the home position, the movable contact S13 of the switch S1 and the movable contact S23 of the switch S2 are located at their respective initial positions. When the slider 200 is located at the depressed position, the movable contact S13 of the switch S1 and the movable contact S23 of the switch S2 are located at their respective moved positions. A recess is centrally provided in the face on the second side in the third direction Y of the bottom 240. The bottom of the recess has a columnar housing hole 244.

As illustrated in FIGS. 2A to 3B, the keytop 100 fixedly covers the ceiling 210 of the slider 200. The keytop 100 is movable in the first direction Z, together with the slider 200, with respect to the body 300*a* and the case 300*b*. The keytop 100 includes the P mark 110, an opening 120, and a mounting portion 130. The P mark 110 is made of a translucent material. As illustrated in FIGS. 2A and 2B, the opening 120 is provided on the first side in the third direction Y with respect to the P mark 110. The opening 120 has a shape conforming to the outer shape of a fitting protrusion 710*a* (to be described) of the lens 700*a*. As illustrated in FIGS. 2A to 2D, the mounting portion 130 is a recess under the P mark 110, with a shape conforming to the outer shape of the light shield block 700*b*.

The lens 700*a* includes the fitting protrusion 710*a* to fit in the opening 120. The lens 700*a* is disposed above the electronic component 500*a*. The lens 700*a* directs light emitted from the electronic component 500*a* to the outside of the keytop 100.

The light shield block 700*b* is a generally rectangular frame that is made of a material having a light shielding property and includes a shield plate 710*b*. The light shield block 700*b* fits in the mounting portion 130, and the inside of the light shield block 700*b* is located above the electronic component 500*b*. The shield plate 710*b* is located between the electronic component 500*a* and the electronic component 500*b*. This arrangement allows light emitted from the electronic component 500*b* to pass through the light shield block 700*b* and illuminate the P mark 110 of the keytop 100. On the other hand, the light is blocked by the light shield block 700*b* and the shield plate 710*b* so as not to leak to the lens 700*a* side. Similarly, light emitted from the electronic component 500*a* is also blocked by the light shield block 700*b* and the shield plate 710*b* so as not to leak to the P mark 110 side.

As illustrated in FIGS. 2A to 2D, the tactile feel generator 900 includes an elongated ridge 910, the ball 920, and the coil spring 930. The elongated ridge 910 extends in the first direction Z on the inner face of the main body 310*a*, between the first holder 320*a* and the third holder 340*a*. The elongated ridge 910 faces the housing hole 244 in the bottom 240 of the slider 200. The elongated ridge 910 has a step 911. The outer diameter of the coil spring 930 is slightly smaller than the diameter of the housing hole 244 of the slider 200. The length of the coil spring 930 is larger than the depth of the housing hole 244. Accordingly, the coil spring 930 is housed at its first lengthwise end in the housing hole 244 and protrudes at its second lengthwise end from the housing hole 244. The diameter of the ball 920 is slightly larger than the outer diameter of the coil spring 930. The ball 920 partially fits in the second lengthwise end of the coil spring 930. The sum of the diameter of the ball 920 and the length of the coil spring 930 is larger than the distance in the third direction Y between the bottom of the housing hole 244 and the elongated ridge 910. This arrangement results in that the coil spring 930 elastically presses the ball 920 against the elongated ridge 910. When the slider 200 moves from the home position to the depressed position, the ball 920 climbs over the step 911 of the elongated ridge 910. As a result, a tactile feel is generated in the depressing operation of the keytop 100.

The push switch configured as described above may be manufactured in the following steps. The first step is to prepare the first and second fixed contacts S11 and S12 of the switch S1, the terminals T1 to T5, and the first and second fixed contacts S21 and S22 of the switch S2. Then, the following parts are placed at intervals into a mold (not shown): (1) the bent portions, the embedded portions and the contact portions of the first and second fixed contacts S11 and S12, (2) the first bent portions, the second bent portions and the embedded portions of the terminals T1 to T5, and (3) the bent portions, the embedded portions and the contact portions of the first and second fixed contacts S21 and S22. Particularly, the first fixed contact S11, the second fixed contact S12, the terminals T1, T2, T3, T4 and T5, the second fixed contact S22, and the first fixed contact S21 are arrayed in this order at intervals along the second direction X. Plastic material is poured into the mold to embed the above mentioned parts (1) to (3) in the plastic material. The plastic material hardens to form the main body 310*a*, the first, second and third holders 320*a*, 330*a* and 340*a* of the body 300*a*, and the elongated ridge 910.

More particularly, the above parts (1) to (3) are insert molded in the main body 310*a* of the body 300*a*. The connection portions of the first and second fixed contacts S11 and S12, the connection portions of the terminals T1 to T5, and the connection portions of the first and second fixed contacts S21 and S22 are disposed inside the recess 311*a* of the main body 310*a*. The contact portions of the first and second fixed contacts S11 and S12 are exposed from the recess 312*a* of the main body 310*a*, and the contact portions of the first and second fixed contacts S21 and S22 are exposed from the recess 313*a* of the main body 310*a*. The second bent portions of the terminals T1 to T5 are insert-molded in the main body 310*a* and the third holder 340*a* of the body 300*a*.

Next, the terminals T6 to T8 are prepared. The first bent portions of the terminals T6 to T8 are fitted into the associated attaching recesses 321*a*1 to 321*a*3 of the first holder 320*a*. The second bent portions of the terminals T6 to T8 are fitted into the associated attaching recesses 342*a* to 344*a* of the third holder 340*a*. The fixed portions of the terminals T6 to T8 thus come into contact with the inner face of the main body 310*a*. The fixed portions of the terminals T6 to T8 are fixed to the bosses on the inner face of the main body 310*a*.

Next, the first circuit board 400*a* with the first circuits 600*a* is prepared. The guide recesses 420*a* of the first circuit board 400*a* are fitted over the associated pillars 331*a* of the second holder 330*a*. Accordingly, the pair of protrusions 410*a* of the first circuit board 400*a* comes into contact with the pillars 331*a*. The first circuit board 400*a* in this state is moved to the second side in the first direction Z along the pillars 331*a*. Accordingly, the protrusions 410*a* of the first circuit board 400*a* are placed on the respective pedestals 322*a* of the first holder 320*a* and securely positioned by the pillars 331*a*. Also, the through-hole electrodes 430*a* of the first circuit board 400*a* receive therethrough (a) the connection portions of the first and second fixed contacts S11 and S12, (b) the connection portions of the terminals T1 to T5, (c) the connection portions of the first and second fixed contacts S21 and S22, and (d) the connection portions of the terminals T6 to T8 (i.e. these connection portions pass through the first circuit board 400*a*). Then, these connection portions (a) to (d) are soldered to the associated through-hole electrodes 430*a* of the first circuit board 400*a*. As a result, the first circuits 600*a* on the first circuit board 400*a* are electrically connected to the first and second fixed contacts S11 and S12 of the switch S1, the first and second fixed contacts S21 and S22 of the switch S2, and the terminals T3 to T6.

Next, the second circuit board 400*b* with the second circuits 600*b* and the electronic components 500*a* and 500*b* is prepared. The projections 331*a*1 of the pillars 331*a* are fitted in the pair of fitting holes 410*b* and the pair of fitting recesses 420*b* of the second circuit board 400*b*. Accordingly, the second circuit board 400*b* is held on the pillars 331*a* of the second holder 330*a*. Also, the through-hole electrodes 430*b* of the second circuit board 400*b* receive therethrough the above connection portions (a) to (d) (i.e. these connection portions pass through the second circuit board 400*b*). Then, these connection portions (a) to (d) are soldered to the associated through-hole electrodes 430*b* of the second circuit board 400*b*. As a result, the first side second circuit 600*b* and the electronic component 500*a* on the second circuit board 400*b* are electrically connected to the first and second fixed contacts S11 and S12 of the switch S1 and to the terminals T1 and T2. The second side second circuit 600*b* and the electronic component 500*b* on the second circuit board 400*b* are electrically connected to the first and second fixed contacts S21 and S22 of the switch S2 and to the terminals T7 and T8. The electronic component 500*a* is electrically connected also to the terminals T3 and T4. The electronic component 500*b* is electrically connected also to the terminals T5 and T6.

The keytop 100, the lens 700*a*, and the light shield block 700*b* are also prepared. The fitting protrusion 710*a* of the lens 700*a* is fitted into the opening 120 of the keytop 100, while the light shield block 700*b* is fitted into the mounting portion 130 of the keytop 100. Then, the slider 200 is prepared. The cushion 250 fits in the attaching groove 222 of the slider 200. The movable contacts S13 and S23 are also prepared. The fixed plates S13*a* of the movable contact S13 and the fixed plate S23*a* of the movable contact S23 are fixed to the bosses 243 of the slider 200. The keytop 100 is then attached to the slider 200.

The case 300*b* is also prepared. The rails 231 of the slider 200 are fitted into the associated rail grooves 312*b*1 of the case 300*b*, and the rails 311*b*1 of the case 300*b* are fitted into the associated rail grooves 221 of the slider 200. Accordingly, the slider 200 is attached to the case 300*b* in a movable manner in the first direction Z. The coil spring 800 is also prepared. The first lengthwise end of the coil spring 800 is partially housed inside the housing recess 314*b*1 of the case 300*b*. The slider 200 is then moved to the second side in the first direction Z relative to the case 300*b* to insert the projection 242 of the slider 200 into the second lengthwise end of the coil spring 800.

The ball 920 and the coil spring 930 are also prepared. The first lengthwise end of the coil spring 930 is housed in the housing hole 244 of the slider 200, while the ball 920 is fitted into the second lengthwise end of the coil spring 930. In this state, the case 300*b* is fixed to the main body 310*a* of the body 300*a*, resulting in the following arrangement. The third holder 340*a* of the body 300*a* closes the thorough-hole 313*b*1 of the bottom plate 313*b* of the case 300*b*. The first lengthwise end of the coil spring 800 is partially housed in the housing recess 341*a* of the bottom plate 313*b*. The first housing space $\alpha$1 of the case 300*b* houses the slider 200, the movable contacts S13 and S23, and the coil spring 800. The second housing space $\alpha$2 of the slider 200 houses the first and second holders 320*a* and 330*a*, the first and second circuit boards 400*a* and 400*b*, the electronic components 500*a* and 500*b*, the terminals T6 to T8, the ball 920, and the coil spring 930. The ball 920 abuts the elongated ridge 910 of the body 300*a*, and the coil spring 930 is compressed between the ball 920 and the bottom of the housing hole 244. The stop 323*a* of the first holder 320*a* is received in the through-hole 222 of the slider 200. The tail portions T15 to T85 of the terminals T1 to T8 are received into the connection portion 320*b* through the opening 321*b* of the case 300*b*. In this manner, the push switch is fabricated.

The push switch may operate in the following manner. When the keytop 100 and the slider 200 are located at their home positions, the movable contact S13 of the switch S1 is located at its initial position, and the movable contact S23 of the switch S2 is located at its initial position. More particularly, the sliding arm S13*b* and the sliding arm S13*c* of the movable contact S23 are in contact with the first fixed contact S11 and the second fixed contact S12, respectively, while the sliding arm S23*b* of the movable contact S23 is not in contact with the contact portion S21*d* of the first fixed contact S21. Therefore, the first and second fixed contacts S11 and S12 are electrically connected (the switch S1 is on), so that the associated second circuit 600*b* on the second circuit board 400*b* allows the electronic component 500*a* to glow. On the other hand, the first and second fixed contacts S21 and S22 are not electrically connected (the switch S2 is off), so that the associated second circuit 600*b* on the second circuit board 400*b* maintains the electronic component 500*b* in an off state. Light emitted from the electronic component 500*a* emits to the outside of the keytop 100 through the lens 700*a*.

When the keytop 100 is depressed, the rails 231 of the slider 200 are guided along the associated rail grooves 312*b*1 of the case 300*b*, and the rails 311*b*1 of the case 300*b* are guided along the associated rail grooves 221 of the slider 200. The keytop 100 and the slider 200 thus move in the first direction Z from the home positions to the depressed positions relative to the case 300*b*. The movable contact S13 of the switch S1 accordingly moves from the initial position to the moved position, and the movable contact S23 of the switch S2 moves from the initial position to the moved position. When the movable contact S13 of the switch S1 is located at the moved position, the distal end of the sliding arm S13*b* of the movable contact S13 is brought out of contact with the contact portion S11*d* of the first fixed contact S11. This electrically disconnects the first and second fixed contacts S11 and S12 (the switch S1 is turned off), and the associated second circuit 600*b* on the second circuit board 400*b* turns off the electronic component 500*a*. When the movable contact S23 of the switch S2 is located at the moved position, the distal end of the sliding arm S23*b* and the distal end of the sliding arm S23*c* of the movable contact S23 come into contact with the contact portion S21*d* of the first fixed contact S21 and the contact portion S22*d* of the second fixed contact S22, respectively. This establishes electrical connection between the first and second fixed contacts S21 and S22 (the switch S2 is turned on), and the associated second circuit 600*b* on the second circuit board 400*b* turns on the electronic component 500*b*. Light emitted from the electronic component 500*b* illuminates the P mark 110 of the keytop 100.

When the keytop 100 and the slider 200 move from the home positions to the depressed positions, the ball 920 climbs over the step 911 of the elongated ridge 910 of the body 300*a*. As a result, a tactile feel is generated in the depressing operation of the keytop 100. The cushion 250 elastically abuts the support base 314*b* of the case 300*b* to reduce the impact to the slider 200 during the pressing operation of the keytop 100. The coil spring 800 is compressed between the bottom 240 of the slider 200 and the bottoms of the housing recesses 341*a* and 314*b*1 to apply a returning force to the slider 200 to return to the home position.

When the keytop 100 is released from the depressing operation, the biasing force of the coil spring 800 causes the rails 231 of the slider 200 to be guided along the associated rail grooves 312*b*1 of the case 300*b* and the rails 311*b*1 of the case 300*b* to be guided along the associated rail grooves 221 of the slider 200. The slider 200 is thereby pushed up from the depressed position to the home position. The movable contact S13 of the switch S1 accordingly returns from the moved position to the initial position, and the movable contact S23 of the switch S2 returns from the moved position to the initial position. As a result, the push switch is brought back to the original state as described above, i.e. the switch S1 is on, the switch S2 is off, the electronic component 500*a* is on, and the electronic component 500*b* is off. Accordingly, the cushion 250 elastically abuts the stop 323*a* of the first holder 320*a* to reduce the impact to the slider 200 during the return of the keytop 100 to the home position.

The push switch as described above has the following technical features. Firstly, the push switch can be downsized due to the following arrangement. The first circuit board 400*a* is provided with the first circuits 600*a* for protecting the switches S1 and S2, and the second circuit board 400*b* is provided with the electronic components 500*a* and 500*b* and the second circuits 600*b*. The first circuit board 400*a* and the second circuit board 400*b* are held in spaced relation to each other along the first direction Z by the first holder 320*a* and the second holder 330*a* of the body 300*a*. This arrangement can reduce the projected area from the first direction Z of the body 300*a* and the case 300*b* as combined.

Secondly, the above push switch has high versatility due to the following arrangement. The electronic components 500*a* and 500*b*, and the second circuits 600*b* are provided in the second circuit board 400*b*. Therefore, by removing the second circuit board 400*b*, the push switch can be modified to a push switch that does not require the electronic components 500*a* and 500*b*, and the second circuits 600*b*. Alternatively, by replacing the second circuit board 400*b* with another second circuit board provided with a different electronic component and a different second circuit for actuating the electronic component, the push switch can also be applied to a push switch for such a different electronic component.

Thirdly, the push switch is easy to manufacture due to the following arrangement. When making the first and second holders 320*a* and 330*a* hold the first and second circuit boards 400*a* and 400*b*, these circuit boards are electrically connected to the connection portions S11*a*, S12*a*, S21*a* and S22*a* of the first and second fixed contacts S11, S12, S21, and S22 of the switches S1 and S2, and to the connection portions T11 to T18 of the terminals T1 to T8. Specifically, when making the first holder 320*a* hold the first circuit board 400*a*, the connection portions S11*a*, S12*a*, S21*a* and S22*a* of the first and second fixed contacts S11, S12, S21, and S22 of the switches S1 and S2, and the connection portions T11 to T18 of the terminals T1 to T8 are inserted through and electrically connected to the associated through-hole electrodes 430*a* of the first circuit board 400*a*. Also, when making the second holder 330*a* hold the second circuit board 400*b*, the connection portions S11*a*, S12*a*, S21*a* and S22*a* of the first and second fixed contacts S11, S12, S21, and S22 of the switches S1 and S2, and the connection portions T11 to T18 of the terminals T1 to T8 are inserted through and electrically connected to the associated through-hole electrodes 430*b* of the second circuit board 400*b*. Therefore, the above arrangement can make it possible to fix the first and second circuit boards 400*a* and 400*b* in position with respect to the body 300*a* and simultaneously to establish electrical connection of the first and second circuit boards 400*a* and 400*b* to the first and second fixed contacts S11, S12, S21, and S22 and the terminals T1 to T8.

Fourthly, it is easy to place and fix the first circuit board 400*a* in position on the first holder 320*a*. This is because the first circuit board 400*a* is guided along the pillars 331*a* of the second holder 330*a* and then placed on the first holder 320*a*.

It should be noted that the push switch of the invention is not limited to the above embodiment but can be modified in any manner within the scope described in the appended claims. Specific modifications will be described below.

The slider 200 of the above embodiment is held by the case 300*b* so as to be slidable in the first direction Z between the home position and the depressed position. However, the slider of the invention can be modified in any manner as long as it is held by at least one of the case and the body so as to be movable in the first direction.

The keytop 100 of the above embodiment is attached to the slider 200. However, the keytop can be modified in any manner as long as it is movable in the first direction. For example, the keytop of the invention can be integrally formed with the slider.

The push switch of the above embodiment is provided with the normally closed switch S1 and the normally open switch S2. However, the push switch of the invention is only required to include at least one of a normally closed switch and a normally open switch.

The switch S1 of the above embodiment includes the first and second fixed contacts S11 and S12 formed of metal plates, and the movable contact S13 which is a slider formed of a metal plate. Further, the switch S2 includes the first and second fixed contacts S21 and S22 formed of metal plates, and the movable contact S23 which is a slider formed of a metal plate. However, the invention requires at least one switch that can turn on or off in response to the movement of the keytop. For example, each switch may be a tactile switch to be mounted on the first circuit board or the second circuit board. The tack switch may be turned on or off when depressed by the keytop or the slider moving in the first direction. Further, each switch may include first and second fixed contacts mounted on the first circuit board or the second circuit board, and a snap plate in contact with the first fixed contact. In this case, the snap plate may be brought into contact with the second fixed contact when depressed by the keytop or the slider moving in the first direction.

In the above embodiment, the contact portion S11*d* of the first fixed contact S11 and the contact portion S12*d* of the second fixed contact S12 are exposed from the bottom of the recess 312*a* of the main body 310*a*. Further, the contact portion S21*d* of the first fixed contact S21 and the contact portion S22*d* of the second fixed contact S22 are exposed from the bottom of the recess 313*a* of the main body 310*a*. However, the contact portions of the first and second fixed contacts of the invention may be exposed from the inner face of the main body.

In the above embodiment, the connection portion S11*a* of the first fixed contact S11 and the connection portion S12*a* of the second fixed contact S12 are disposed inside the recess 311*a* of the main body 310*a*. The connection portion S21*a* of the first fixed contact S21 and the connection portion S22*a* of the second fixed contact S22 are also disposed inside the recess 311*a* of the main body 310*a*. However, the connection portions of the first and second fixed contacts of the invention may be disposed outside the body and pass through the first and second circuit boards. The embedded portions of the first and second fixed contacts can be modified in any manner as long as they are embedded in the main body. The bent portions of the first and second fixed contacts may be of an L shape or any other shape with a bent that allows the connection portions to pass through the first and second circuit boards.

In the above embodiment, the movable contact S13 includes the fixed plate S13*a*, and the sliding arms S13*b* and S13*c*. Further, the movable contact S23 includes the fixed plate S23*a*, and the sliding arms S23*b* and S23*c*. However, the invention requires at least one movable contact that has the first or second configuration as follows. The first configuration is such that a movable contact is not in contact with at least one of the first and second fixed contacts at its initial position and moves from the initial position in response to the movement of the keytop to make contact with the first and second fixed contacts. The second configuration is such that a movable contact is in contact with the first and second fixed contacts at its initial position and moves from the initial position in response to the movement of keytop so as to be brought out of contact with at least one of the first and second fixed contacts.

The second circuit board 400*b* of the above embodiment is provided thereon with the electronic components 500*a* and 500*b* and the second circuits 600*b*. However, the second circuit board of the invention can be modified in any manner as long as it is provided thereon with at least one electronic component and a second circuit for actuating the electronic component in response to turn-on or turn-off of the switch. The electronic components 500*a* and 500*b* may be LEDs as in the above embodiment or may be of any other kind. For example, the electronic component(s) may be a microphone or a speaker.

The second circuit board 400*b* of the above embodiment is provided with the fitting holes 410*b* and the fitting recesses 420*b*. The second circuit board of the invention may be of any configuration adapted to be held by the second holder of the body in spaced relation to the first circuit board in the first direction.

The first circuit board 400*a* of the above embodiment is provided with the protrusions 410*a* and the guide recesses 420*a*. However, the first circuit board of the invention may be of any shape adapted to be held by the first holder of the body. For example, the first circuit board may be provided with at least one guide recess only in which the pillars of the second holder fit so as to be movable in the first direction.

The body 300*a* of the above embodiment includes the main body 310*a*, the first holder 320*a*, the second holder 330*a*, and the third holder 340*a*. However, the body of the invention can be any body including a main body, a first holder provided at the main body for holding the first circuit board, and a second holder provided at the main body or the first holder for holding the second circuit board in spaced relation to the first circuit board in the first direction. For example, the body may include a main body and first and second holders provided at the main body in spaced relation to each other in the first direction, and the first and second holders may hold the first and second circuit boards, respectively. In this case, each of the first and second holders may include one or more plates or pedestals for holding the first circuit board and the second circuit board, respectively. Further, the first and second holders may be connection portions of a switch and/or a terminal. Specifically, the connection portions of a switch and/or a terminal may pass through the first and second circuit boards to hold the first and second circuit boards in spaced relation to each other along the first direction.

The second holder 330*a* of the above embodiment includes the four pillars 321*a* on the first holder 320*a*. However, the second holder of the invention can be modified in any manner as long as it is provided at the main body or the first holder, the second holder being configured to hold the second circuit board in spaced relation to the first circuit board in the first direction. For example, the second holder may be modified in the above described manner.

The case 300*b* of the above embodiment is attached to the main body 310*a* of the body 300*a*. However, the case of the invention is not limited thereto. For example, the case may be integral with the body.

The push switch of the above embodiment includes the lens 700*a*, the light shield block 700*b*, the coil spring 800 for providing returning force, and the tactile feel generator 900. These components can be omitted. Further, if the first and second contacts include external connection portions, the terminals T1 to T8 can be omitted. The terminals T1 to T8 may be replaced with external connection units of other types, such as cables, pins, and FPCs.

It should be appreciated that the embodiments and modifications are described above by way of examples only. The materials, shapes, dimensions, numbers, arrangements, and other configurations of the constituents of the push switch may be modified in any manner if they can perform similar functions. The push switch of the above embodiment is a parking switch. However, the push switch is applicable to push switches of other types.

REFERENCE SIGNS LIST

100: keytop
200: slider
300*a*: body
310*a*: main body
320*a*: first holder
330*a*: second holder
331*a*: pillar
340*a*: third holder
300*b*: case
310*b*: case body
320*b*: connection portion
400*a*: first circuit board
410*a*: protrusion
420*a*: guide recess
400*b*: second circuit board
410*b*: fitting hole
420*b*: fitting recess
500*a*: electronic component
500*b*: electronic component
600*a*: first circuit
600*b*: second circuit
700*a*: lens
700*b*: light shield block
800: coil spring
900: tactile feel generator
S1: switch
S11: first fixed contact
S12: second fixed contact
S13: movable contact
S2: switch
S21: first fixed contact
S22: second fixed contact
S23: movable contact
T1 to T8: terminal
Z: first direction
X: second direction
Y: third direction

The invention claimed is:

1. A push switch comprising:
a keytop movable in a first direction;
a switch configured to be turned on or off in response to movement of the keytop;
first and second circuit boards electrically connected to the switch,
an electronic component mounted on the second circuit board;
a first circuit provided on the first circuit board;
a second circuit provided on the second circuit board and configured to actuate the electronic component in response to a turn-on or turn-off of the switch; and
a body, the body including:
a main body;
a first holder provided at the main body, the first holder being configured to hold the first circuit board; and
a second holder provided at the main body or the first holder, the second holder being configured to hold the second circuit board in spaced relation to the first circuit board in the first direction,
wherein a main surface of the first circuit board and a main surface of the second circuit board both extend substantially horizontally in a second direction perpendicular to the first direction, and
wherein the first circuit is a protection circuit.

2. The push switch according to claim 1, wherein the switch includes:
first and second fixed contacts, each comprising a metal plate passing through the first and second circuit boards; and
a movable contact, the movable contact at an initial position not being in contact with at least one of the first fixed and second fixed contacts, the movable contact being movable from the initial position in response to the movement of the keytop to be in contact with the first and second fixed contacts.

3. The push switch according to claim 1, wherein the switch includes:
first and second fixed contacts, each comprising a metal plate passing through the first and second circuit boards; and
a movable contact, the movable contact at an initial position being in contact with the first fixed and second fixed contacts, the movable contact being movable from the initial position in response to the movement of the keytop so as to be brought out of contact with at least one of the first and second fixed contacts.

4. The push switch according to claim 2, wherein
the body partially holds the first and second fixed contacts, and
the first and second fixed contacts each include a connection portion, the connecting portion being disposed outside the body and passing through the first and second circuit boards.

5. The push switch according to claim 3, wherein
the body partially holds the first and second fixed contacts, and
the first and second fixed contacts each include a connection portion, the connecting portion being disposed outside the body and passing through the first and second circuit boards.

6. The push switch according to claim 1, wherein
the second holder includes a plurality of pillars on the first holder, the pillars extending in the first direction,
the second circuit board is held on the pillars, and the first circuit board is placed on the first holder so as to abut the pillars and be fixed in position by the pillars.

7. The push switch according to claim 2, wherein the second holder includes a plurality of pillars on the first holder, the pillars extending in the first direction, the second circuit board is held on the pillars, and the first circuit board is placed on the first holder so as to abut the pillars and be fixed in position by the pillars.

8. The push switch according to claim 3, wherein the second holder includes a plurality of pillars on the first holder, the pillars extending in the first direction, the second circuit board is held on the pillars, and the first circuit board is placed on the first holder so as to abut the pillars and be fixed in position by the pillars.

9. The push switch according to claim 4, wherein the second holder includes a plurality of pillars on the first holder, the pillars extending in the first direction, the second circuit board is held on the pillars, and the first circuit board is placed on the first holder so as to abut the pillars and be fixed in position by the pillars.

10. The push switch according to claim 5, wherein the second holder includes a plurality of pillars on the first holder, the pillars extending in the first direction, the second circuit board is held on the pillars, and the first circuit board is placed on the first holder so as to abut the pillars and be fixed in position by the pillars.

11. The push switch according to claim 6, wherein the first circuit board includes a guide recess configured to fittingly receive the pillars in a movable manner in the first direction.

12. The push switch according to claim 7, wherein the first circuit board includes a guide recess configured to fittingly receive the pillars in a movable manner in the first direction.

13. The push switch according to claim 8, wherein the first circuit board includes a guide recess configured to fittingly receive the pillars in a movable manner in the first direction.

14. The push switch according to claim 9, wherein the first circuit board includes a guide recess configured to fittingly receive the pillars in a movable manner in the first direction.

15. The push switch according to claim 10, wherein the first circuit board includes a guide recess configured to fittingly receive the pillars in a movable manner in the first direction.

* * * * *